US005132719A

United States Patent [19]

Kioka et al.

[11] Patent Number: 5,132,719

[45] Date of Patent: Jul. 21, 1992

[54] METHOD AND APPARATUS FOR DUPLEX PRINTING WHEREIN THE INTERLEAVE NUMBER CHANGES IN RESPONSE TO DETECTED SHEET LENGTH CHANGE

[75] Inventors: Hidekatsu Kioka, Yokohama; Mitsuo Tanaka, Machida, both of Japan

[73] Assignee: Ricoh Company, Ltd., Tokyo, Japan

[21] Appl. No.: 648,157

[22] Filed: Jan. 30, 1991

[30] Foreign Application Priority Data

Feb. 8, 1990 [JP] Japan ..... 2-29171

[51] Int. Cl.[5] ..... G03G 21/00

[52] U.S. Cl. ..... 355/24; 355/77; 355/319

[58] Field of Search ..... 355/308, 309, 311, 318, 355/319, 23, 24, 77; 271/225

[56] References Cited

U.S. PATENT DOCUMENTS

| | | | |
|---|---|---|---|
| 4,453,841 | 6/1984 | Bobick et al. | 355/24 X |
| 4,692,020 | 9/1987 | Tsujihara | 355/319 |
| 4,853,740 | 8/1989 | Ushio et al. | 355/319 |
| 4,899,182 | 2/1990 | Inoue | 346/153 |
| 4,935,786 | 6/1990 | Veeder | 355/319 |
| 4,956,678 | 9/1990 | Kiya et al. | 355/318 |
| 4,975,738 | 11/1990 | Senma et al. | 355/77 |
| 4,990,965 | 2/1991 | Kiya | 355/319 |
| 4,992,835 | 2/1991 | Matsuzaka | 355/312 |
| 5,003,355 | 3/1991 | Tanzawa | 355/319 |
| 5,038,173 | 8/1991 | Kusumoto | 355/211 |

FOREIGN PATENT DOCUMENTS

| | | |
|---|---|---|
| 3700397 | 1/1987 | Fed. Rep. of Germany . |
| 4038307 | 11/1990 | Fed. Rep. of Germany . |

*Primary Examiner*—A. T. Grimley
*Assistant Examiner*—J. E. Barlow, Jr.
*Attorney, Agent, or Firm*—Cooper & Dunham

[57] ABSTRACT

A method for forming a duplex print, in which a recording sheet has images formed on both sides thereof, includes steps of: setting an interleave number depending on a size of the recording sheet; forming the duplex prints under a condition where the number of the recording sheets located in a transport path is equal to or less than the interleave number; determining whether or not a size of the recording sheet supplied from a paper supplying unit is changed; changing the interleave number to a minimum interleave number when the size of the recording sheet is changed; forming the duplex prints with respect to the new sized recording sheet under a condition where the number of the recording sheet located in the transport path is equal to or less than the minimum interleave number. The present invention also provides an apparatus for forming a duplex print, which operates in accordance with the method for forming a duplex print.

25 Claims, 19 Drawing Sheets

METHOD AND APPARATUS FOR DUPLEX PRINTING WHEREIN THE INTERLEAVE NUMBER CHANGES IN RESPONSE TO DETECTED SHEET LENGTH CHANGE

BACKGROUND OF THE INVENTION

The present invention generally relates to a method and an apparatus for forming images on both sides of a recording sheet, and particularly to a method and an apparatus for successively forming images on both sides of different sized recording sheets. The method and the apparatus for forming images on both sides of the recording sheet of the present invention can be adapted for use with different image forming apparatus, such as laser beam printers, copy machines and facsimile machines.

There is a conventional method forming images on both sides of a recording sheet in the following manner. That is, a reversing unit and an image forming unit are provided in a transport path of a recording sheet. First, the image forming unit forms an image on a first side of the recording sheet which is supplied from a paper supplying unit. Then, the recording sheet having the image formed on the first side thereof is reversed by the reversing unit, and then the reversed recording sheet is supplied to the image forming unit. The image forming unit then forms an image on a second side of the recording sheet.

For example, when copying 60 pages of a document onto both sides of 30 recording sheets so that 30 duplex copies are obtained, 30 pages of the document are first copied onto the first sides of 30 recording sheets by the image forming unit. The 30 recording sheets each having an image formed on the first side thereof are then reversed by the reversing unit and then stacked on an intermediate tray. Thereafter, the remaining 30 pages of the document are copied on the second sides of the 30 recording sheets by successively refeeding the stacked recording sheets from the intermediate tray to the image recording unit. The duplex print mode in which the images are formed on both sides of the recording sheets in accordance with the above procedures is often referred to as a stack mode.

A conventional apparatus forms duplex prints in accordance with the stack mode described above.

According to the conventional stack mode, the recording sheets must be uniformly stacked on the intermediate tray to prevent each recording sheet refed from the intermediate tray to the image forming unit from being skewed. However, when images are formed on both sides of different sized recording sheets, it is difficult for the recording sheet to be uniformly stacked on the intermediate tray. For this reason, small sized recording sheets are skewed when refed from the intermediate tray to the image forming unit, so that a paper jam is generated and the quality of the image formed on the second side of the refed recording sheet deteriorates.

In addition, the recording sheets stacked on the intermediate tray must be separated one by one by a separating unit when the stacked recording sheets are successively being refed to the image forming unit. For this reason, when a malfunction of the separating unit occurs, there is a problem in that two or more recording sheets may be simultaneously refed from the intermediate tray to a image forming unit, so that the paper jam may occur.

In addition, when a paper jam occurs, it is difficult to obtain accurate information about the page which is not printed. Thus, there is a problem in that the operation of making the duplex prints in accordance with the stack mode must be repeated from the beginning.

SUMMARY OF THE INVENTION

Accordingly, a general object of the present invention is to provide a novel and useful method and apparatus for forming images cn both sides of a recording sheet.

A more specific object of the present invention is to provide a method and an apparatus for forming images on both sides of a recording sheet in which it is possible to successively form images on both sides of different sized recording sheets without a paper jam occurring.

An additional object of the present invention is to provide a method and an apparatus for forming images on both sides of a recording sheet in which, even if a paper jam occurs, the number of duplex prints which have to be remade is reduced to a minimum and it is easy to resume printing.

A further object of the present invention is to provide a method and apparatus for form images on both sides of a recording sheet in which the interleave number is changed when the size of the recording sheet changes.

The above objects of the present invention are achieved by a method for forming a duplex print, in which a recording sheet has images formed on both sides thereof, in an image forming apparatus which includes paper supplying means for supplying the recording sheet to a transport path within said image forming apparatus, said paper supplying means capable of supplying different sized recording sheets, transport means for transporting the recording sheet in said transport path, image forming means for forming an image on one side of the recording sheet based on input image data, reversing means for reversing the recording sheet which has the image formed on the one side thereof and refeeding means for refeeding the reversed recording sheet to said image forming means, said method comprising the following steps (a) through (f) of: (a) setting an interleave number depending on the size of the recording sheet supplied from said paper supplying means, said interleave number being a maximum number of recording sheets which can be located within the transport path with a non-stacked arrangement; (b) controlling said paper supplying means, said image forming means, said transport means, said reversing means and said refeeding means so that recording sheets having images formed on first sides thereof are located in the transport path with the non-stacked arrangement, the number of recording sheets located within the transport path being equal to the interleave number set by said step (a); (c) forming an image on the first side of the recording sheet supplied from the paper supplying means and forming an image on a second side of a recording sheet refed from said refeeding means by said image forming means in a predetermined sequence so that the number of recording sheets located in the transport path is kept equal to or less than the interleave number; (d) determining whether or not the size of the recording sheet, supplied from said paper supplying means changes; (e) changing the interleave number set by said step (a) to a minimum interleave number when said step (d) determines that the size of the recording sheet has changed, said minimum interleave number being an interleave number dependent on the largest recording sheet of recording sheets which can be supplied to said image forming apparatus; and (f) controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

The present invention is also directed to a method for forming duplex prints, comprising the following steps (a) through (f) of: (a) setting an interleave number depending on the size of the recording sheet supplied from said paper supplying means, said interleave number being a maximum number of recording sheets which can be located within the transport path with a non-stacked arrangement; (b) controlling said paper supplying means, said image forming means, said transport means, said reversing means and said refeeding means so that recording sheets having images formed on first sides thereof are located in the transport path with the non-stacked arrangement, the number of recording sheets located within the transport path being equal to the interleave number set by said step (a); (c)forming an image on the first side of the recording sheet supplied from the paper supplying means and forming an image on a second side of a recording sheet refed from said refeeding means by said image forming means in a predetermined sequence so that the number of recording sheets located in the transport path is kept equal to or less than the interleave number; (d) determining whether or not the size of the recording sheet supplied from said paper supplying means changes; (e) changing the interleave number set by said step (a) to a minimum interleave number when said step (d) determines that the size of the recording sheet has changed, said minimum interleave number being an interleave number dependent on the largest recording sheet of recording sheets which are actually housed by said supplying units; and (f) controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

The present invention is also directed to a method for forming a duplex print, comprising the following steps (a) through (f) of: (a) setting an interleave number depending on the size of the recording sheet supplied from said paper supplying means, said interleave number being a number of recording sheets which can be located within the transport path with a non-stacked arrangement; (b) controlling said paper supplying means, said image forming means, said transport means, said reversing means and said refeeding means so that recording sheets having images formed on first sides thereof are located in the transport path with the non-stacked arrangement, the number of recording sheets located within the transport path being equal to the interleave number set by said step (a); (c) forming an image on the first side of the recording sheet supplied from the paper supplying means and forming an image on a second side of a recording sheet refed from said refeeding means by said image forming means in a predetermined sequence so that the number of recording sheets located in the transport path is kept equal to or less than the interleave number; (d) determining whether or not the size of the recording sheet, supplied from said paper supplying means changes; (e) changing the interleave number set by said step (a) to a minimum interleave number when said step (d) determines that the size of the recording sheet has changed, said minimum interleave number being an interleave number dependent on the largest recording sheet of the new sized recording sheet and the recording sheets supplied to the transport path; and (f) controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

The present invention is also directed to an apparatus for forming a duplex print, which has means for carrying out steps of each method described above.

Additional objects, features and advantages of the present invention will become apparent from the following detailed description when read in conjunction with the accompanying drawings.

DESCRIPTION OF THE PREFERRED EMBODIMENTS

A description will now be given of an embodiment of the present invention with reference to the accompanying drawings.

In the following embodiment, a laser beam printer system capable of making the duplex prints will be described.

Figure 1:
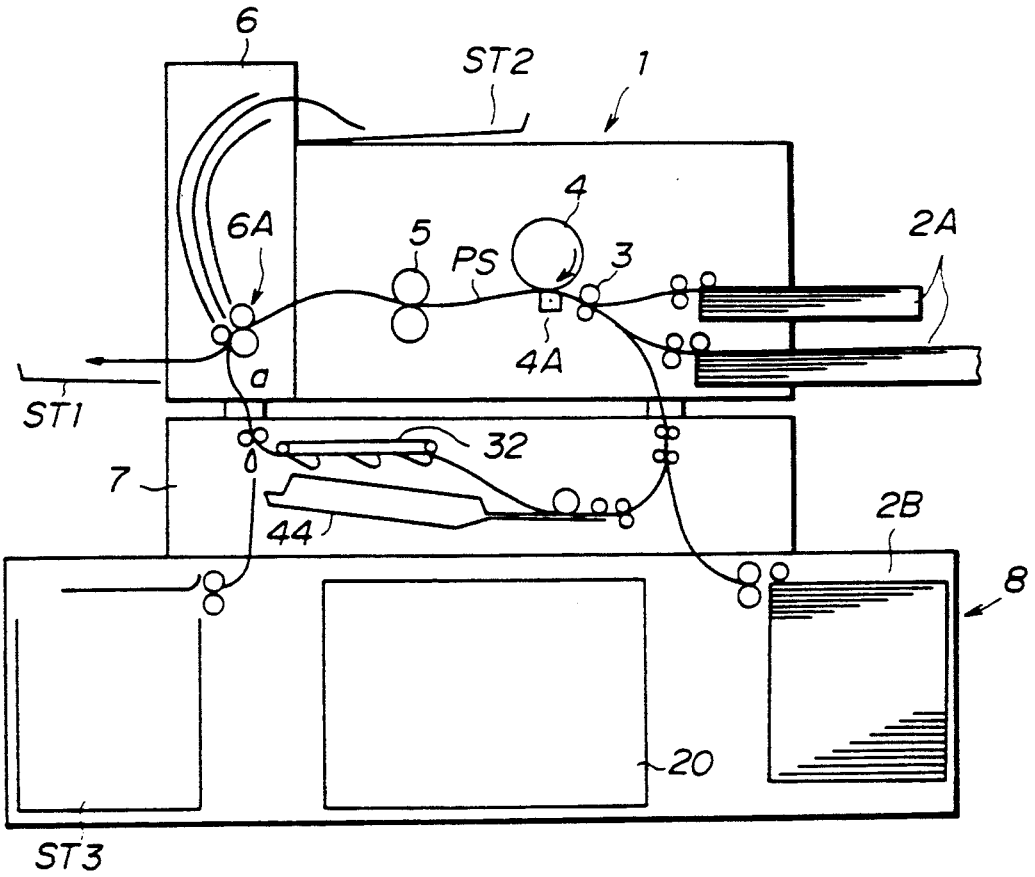
FIG. 1 is a diagram illustrating a laser beam printer system according to an embodiment of the present invention.

Referring to FIG. 1, which conceptually shows the laser beam printer system, the laser beam printer system has a main printer body 1, a reversing unit 6, a duplex unit 7 and a system table 8. In the system table 8, a large capacity paper supplying unit 2B which is capable of supplying a large quantity of recording sheets, a paper stacker ST3 and a control unit 20 are provided. The control unit 20 has a printer controller which entirely controls the system and an engine driver for driving sources in the laser beam printer system.

In this laser beam printer system, a paper supplying unit includes two paper cassettes 2A which are removably provided in the main printer body 1 and the large capacity paper supplying unit 2B provided in the control table 8. The recording sheet is supplied from the paper supplying unit to registration rollers 3, the leading edge of the recording sheet thus engaging with registration rollers 3. The recording sheet is on standby in a state where the leading edge thereof engages with the registration rollers 3. In addition, a laser beam emitted from a laser writing unit (not shown) scans a photosensitive drum 4 so that an electrostatic latent image corresponding to image data is formed on the surface of the photosensitive drum 4. Then, the electrostatic latent image is developed by a developing unit so that a visible image formed of toner is obtained. The toner image formed on the surface of the photosensitive drum 4 is moved toward a transfer charger 4A due to a rotation of the photosensitive drum 4.

The recording sheet which is on standby at a position of the registration rollers 3 described above is fed between the photosensitive drum 4 and the transfer charger 4A by the registration rollers 3 when the toner image formed on the surface of the photosensitive drum 4 faces the transfer charger 4A. Therefore, the toner image is transferred to a first side of the recording sheet, so that the image is formed on the first side of the recording sheet.

Image forming means of the present invention includes the photosensitive drum 4, the laser writing unit, the developing unit, the transfer charger 4A and a controller for forming an image.

The recording sheet having the image formed on the first side thereof is moved in a paper feed path PS, and fed to an image fusing unit 5. The toner image on the recording sheet is fixed by the image fusing unit 5, and then the recording sheet is transported via the paper feed path toward the reversing unit 6.

The reversing unit 6 has rollers 6A which turn over so that the leading edge of the recording sheet supplied to the reversing unit 6 becomes the rear edge thereof and vice versa. That is, the recording sheet is returned back by the rollers 6A and passes through the reversing unit 6 so that the recording sheet is reversed. The recording sheet ejected from a lower outlet (a) of the reversing unit 6 is supplied to the duplex unit 7, passed through an intermediate tray 44 and is refed to the main printer body 1 so that an image can be formed on the second side of the recording sheet.

In the main printer body 1, when the leading edge of the recording sheet supplied from the duplex unit 7 engages with the registration rollers 3, the recording sheet is on standby at the position of the registration rollers 3. Thereafter, a toner image corresponding to another image data is formed on the second side of the recording sheet in accordance with a process identical to that described above, so that a duplex print is obtained. The recording sheet having the images formed on both sides thereof is ejected into one of stackers ST1, ST2 and ST3 via the reversing unit 6. When the recording sheet is supplied to either the stacker ST1 or ST3, the recording sheet is reversed by a returning back operation of the reversing unit 6, so that the recording sheets are sequentially stacked on either the stacker ST1 or ST3 starting from the first page. When the recording sheet is supplied to the stacker ST2 via the reversing unit 6, the recording sheet is automatically reversed. The stacker ST3 is capable of stacking a large quantity of the recording sheets fed from the large capacity paper supplying unit 2B.

An additional description will now be given of the duplex unit 7 with reference to FIGS. 2 and 3.

In the duplex unit 7, the recording sheet supplied thereto from the reversing unit 6 is fed to a gate portion 32 via entrance rollers 41 and a path selector 42. The gate portion 32 has a plurality of path selectors for selecting an ejecting position of the received recording sheet based on the size of the recording sheet. The gate portion 32 ejects the recording sheet onto the intermediate tray 44.

Figure 3:
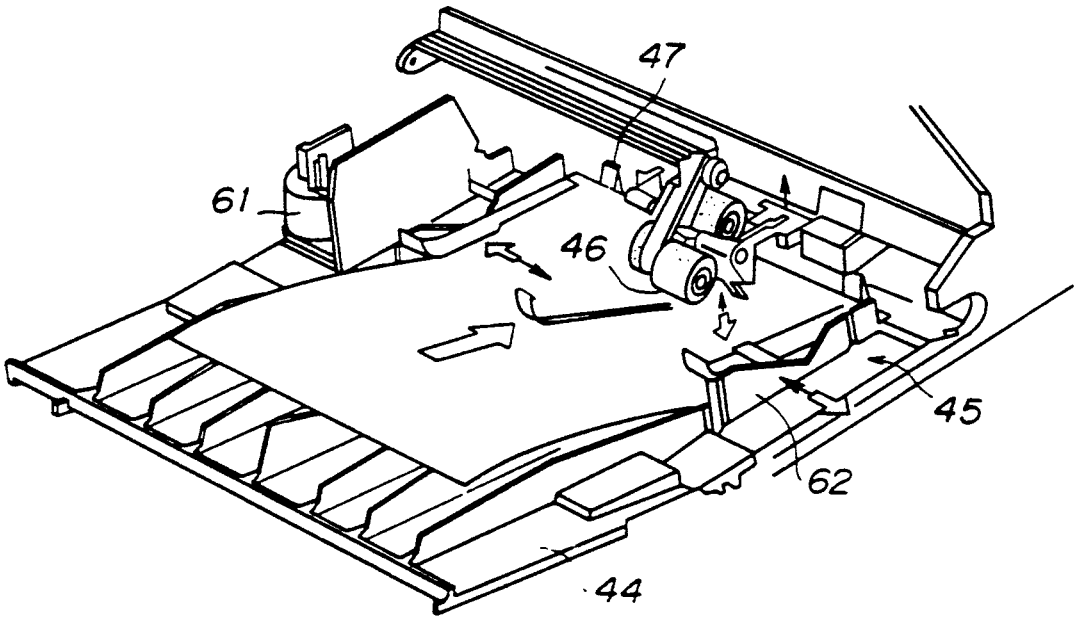
FIG. 3 is a perspective view illustrating an intermediate tray shown in FIG. 2.

The recording sheet which is ejected from the gate portion 32 is fed by a roller 46, shown in FIG. 3, up to a position where the leading edge of the recording sheet hits a stopper member 47. The stopper member 47 is provided on a downstream side of the intermediate tray 44, and is capable of pivoting between a first position and a second position. A jogger unit 45 is also provided on the downstream side of the intermediate tray 44. The jogger unit 45 has a motor 61 and a pair of guide plates 62. The motor 61 drives the guide plates 62 so as to move the guide plates 62 in a direction approximately perpendicular to the transport direction of the recording sheet. The guide plates 62 move simultaneously in opposite directions so as to guide two opposite side ends of the recording sheet and align the position of the recording sheet with respect to the center of the recording sheet along a width direction thereof. The recording sheet which is aligned on the intermediate tray 44 by the jogger unit 45 is refed to the main printer body 1 through an opening OUT1 by intermediate rollers 49 and upper ejecting rollers 50 when the stopper member 47 is switched to the second position.

It is also possible to stack and align a plurality of recording sheets on the intermediate tray 44. However, in the embodiment of the present invention, it is assumed that one recording sheet is aligned on the intermediate tray 44.

In some cases, the recording sheet can be also transported through the intermediate tray 44 without being aligned by the jogger unit 45.

The duplex unit 7 also has a first path which is provided between a opening IN1 and the opening OUT1 and a second path which is formed between an opening which faces the reversing unit 6 and an opening OUT2. The recording sheet which is ejected from the large capacity paper supplying unit 2B is supplied to the first path via the opening IN1 and supplied to the main printer body 1 via the opening OUT1 when an image is formed on one side of the recording sheet. By switching the position of the path selector 42, it is possible to transport the recording sheet which is supplied from the reversing unit 6 to the stacker ST3 via the second path.

Figure 4:
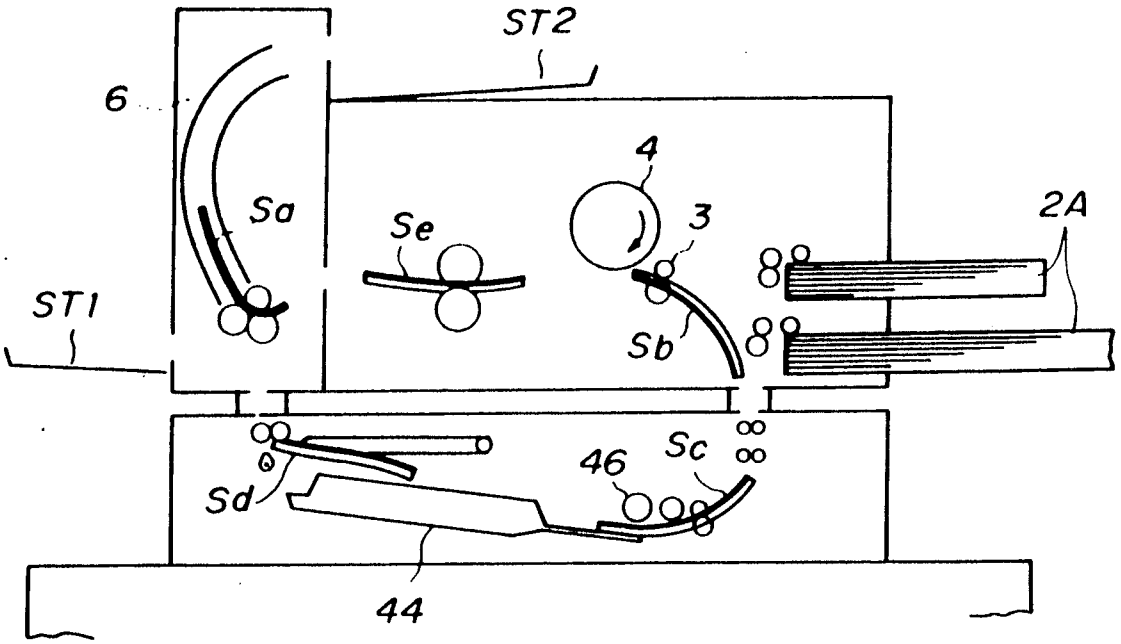
FIG. 4 is a diagram illustrating an example of a state where recording sheets remain in a paper feed path in the laser beam printer.

In this embodiment, the laser beam printer system controls operation timings of various parts thereof when making the duplex prints so that there are no stacked recording sheets in the paper feed path of the laser beam printer system. For example, as shown in FIG. 4, a plurality of the recording sheets Sb, Sc, Sd and Se which have an image formed on each respective first side thereof are separately located in the paper feed path of the laser beam printer system without being stacked. Then another image is respectively formed on each respective second side of the successive recording sheets having the image formed on each first side thereof, so that the images can be successively formed on both sides of the different sized recording sheets.

The recording sheet Sa which has had the images formed on both sides thereof is ejected from the reversing unit 6 to the stacker ST2 provided on the main printer body 1. The recording sheet Sa also may be ejected to either the stacker ST1 or ST3.

The laser beam printer system of this embodiment can select one of the following four types of duplex modes (A) to (D) in which the images are formed on both sides of the recording sheets.

(A) Stack mode
(B) Interleave mode
(C) Flying mode
(D) Through mode

A description will now be given of each of the above four types of duplex modes.

FIGS. 5, 6, 7 and 8 show printing sequences in the cases where twelve pages are printed on both sides of six recording sheets in the above four duplex modes.

Figure 6:
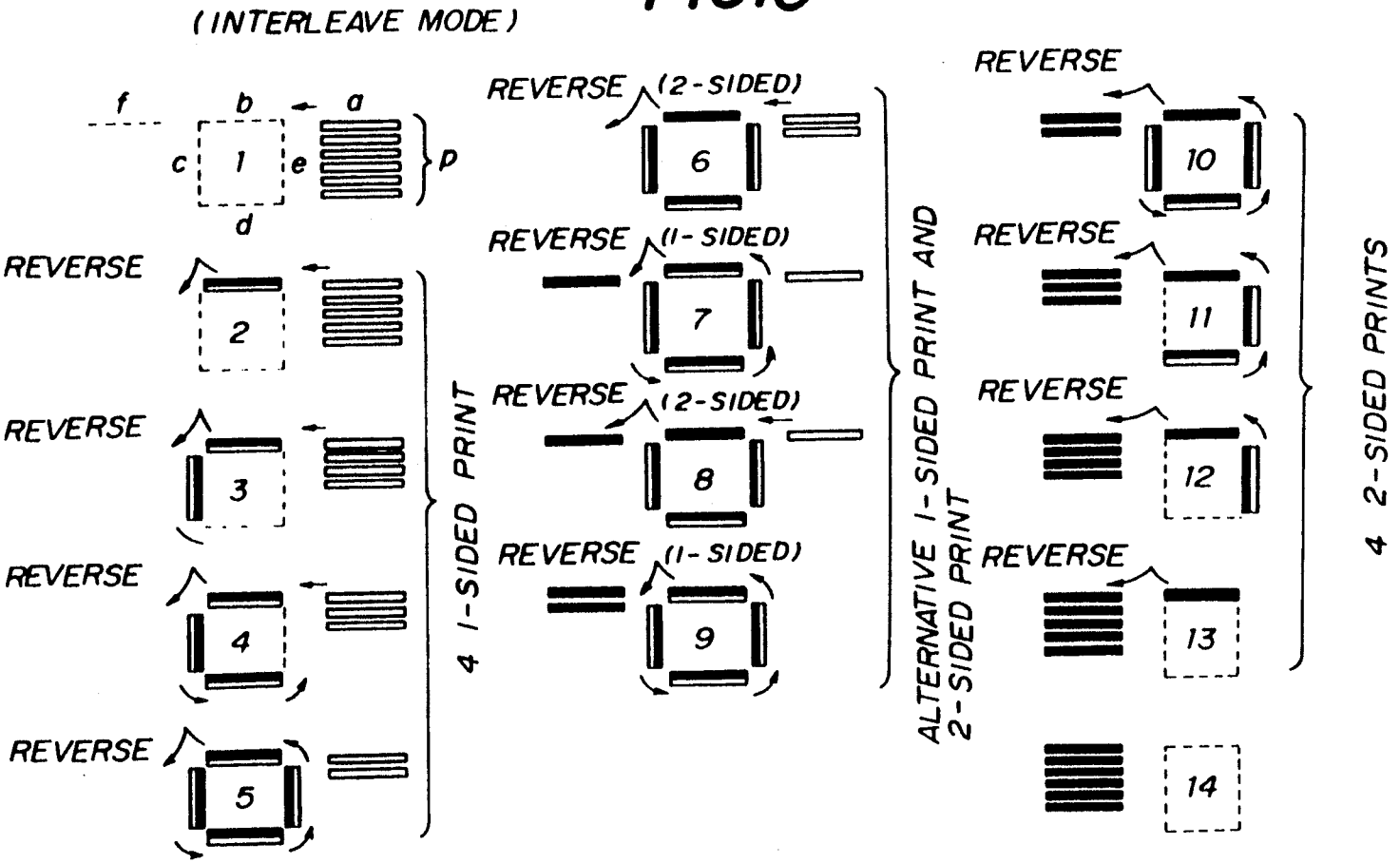
Figure 7:
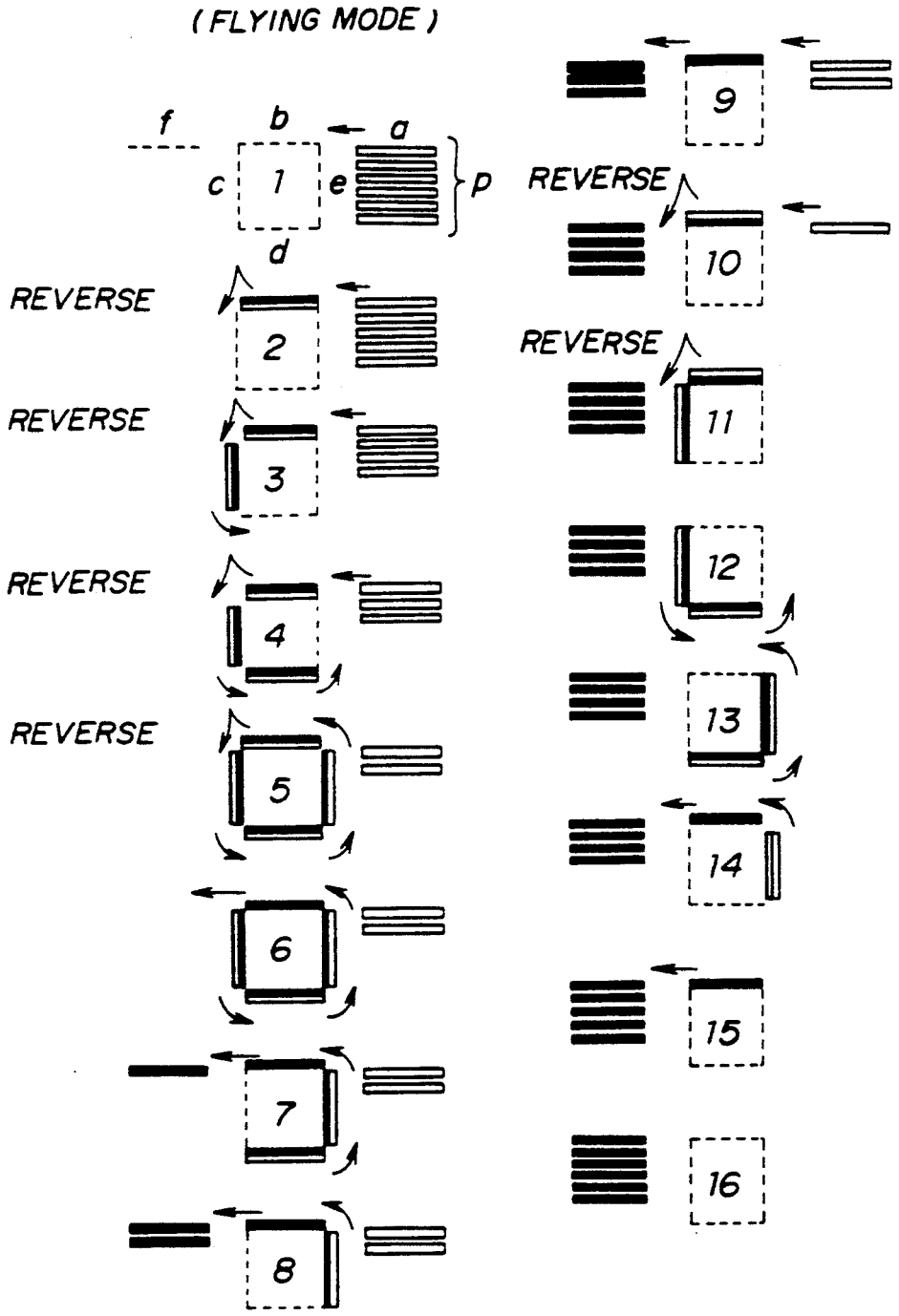

The interleave mode shown in FIG. 6 and the flying mode shown in FIG. 7 are the duplex modes related to the present invention. Referring to FIGS. 6 and 7, the scattering sheet number is four. The scattering sheet number is the number of recording sheets each having an image formed on one respective side thereof, these sheets being separately located in the paper feed path of the laser beam printer system. The scattering sheet number is determined by the length of the paper feed path, the length of the recording sheet, the interval between the adjacent recording sheets in the paper feed path and so on. That is, when the paper feed path of the printer system is long, the length of the recording sheet in a direction in which the recording sheet is transported is small, and the intervals between the adjacent recording sheets in the paper feed path are small, the scattering sheet number can be large.

In FIGS. 5, 6, 7 and 8, the laser beam printer system has a paper supplying portion (a), an image forming portion (b), paper paths (c) (d) and (e) in which the recording sheet having the images formed on one side thereof is transported and a paper ejection portion (f). A reversing portion (not shown) is provided between the image forming portion (b) and the paper path (c). The paper path (d) corresponds to the intermediate tray 44 described above. In addition, (p) denotes the recording sheet, and the recording sheet having no image is denoted by a blank. A sheet which is black on one side is a recording sheet having an image formed on one side thereof, and a sheet which is black on both sides is a recording sheet having an image formed respectively on each side thereof.

(A) Stack mode

Figure 5:
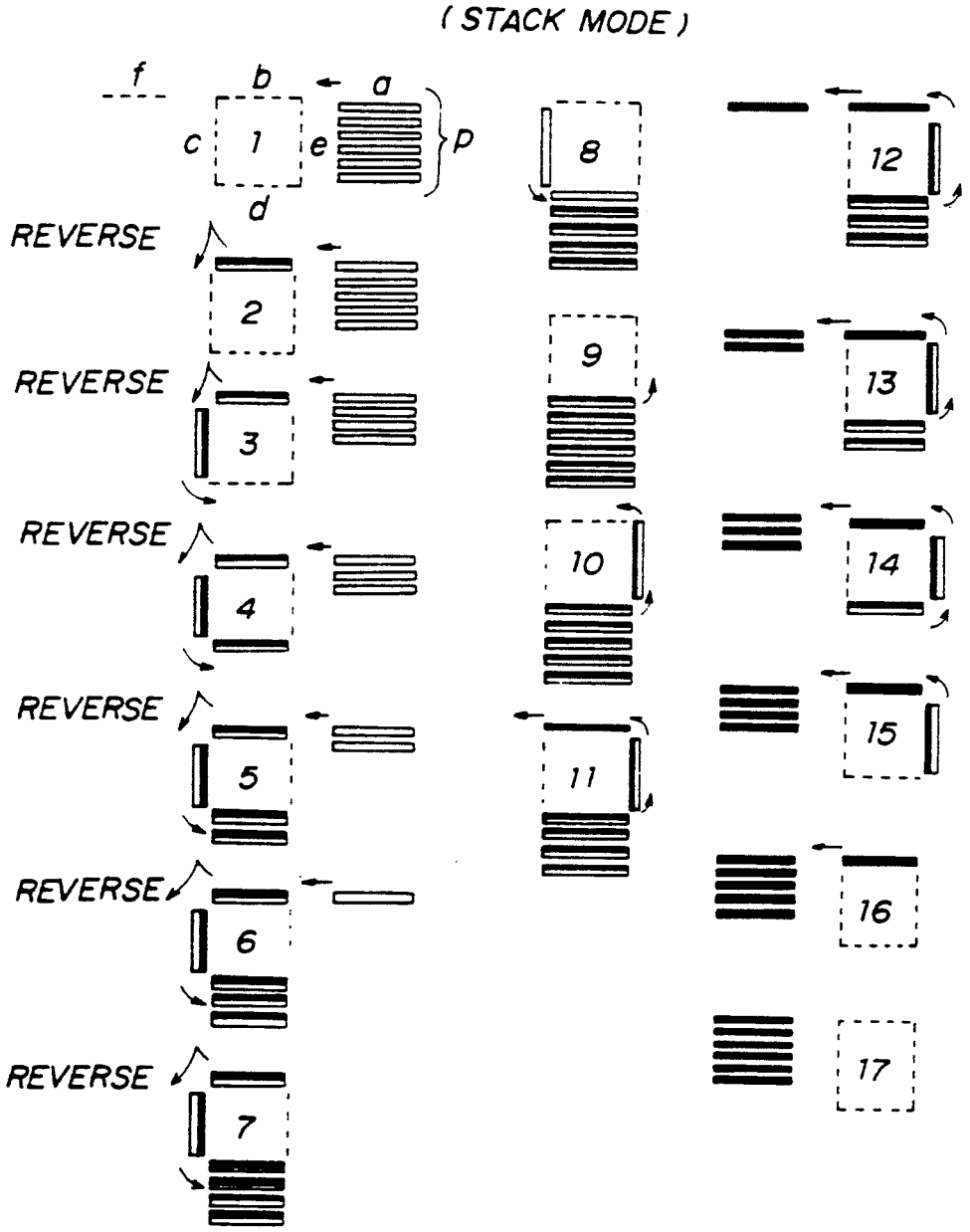
FIGS. 5, 6, 7, and 8 are diagrams illustrating printing orders in duplex modes for forming images on both sides of recording sheets, which duplex modes can be carried out by the laser beam printer shown in FIG. 1.

The stack mode is shown in FIG. 5. The stack mode is a conventional mode for forming a plurality of duplex prints.

Referring to FIG. 5, first, the image of each odd numbered page is sequentially formed on the first side of each recording sheet supplied from the paper supplying portion (a) starting from the first page (p.1). Then each recording sheet which has had the image of an odd numbered page formed on the first side thereof is sequentially reversed by the reversing portion and stacked on the paper path (d) (the intermediate tray ) (steps 2 through 9).

Next, the recording sheets stacked on the paper path (d) are successively refed to the image forming portion (b) one by one. The image forming portion (b) forms each image of each even numbered page on the respective second side of each recording sheet supplied from the paper path (d). Then each recording sheet having the images formed on both sides thereof is transported to the paper ejection portion (f) and stacked thereon (steps 10 through 17). When the last recording sheet which has already had the image of the last even numbered page formed on the second side thereof is ejected to the paper ejection portion (f), the operation in accordance with the stack mode for forming the duplex prints is finished.

In the stack mode, the printing takes place in the following sequence, where even numbered underlined pages indicate prints which are made by forming images on respective back sides (second sides) of the recording sheets. When the image is formed on the back side of the recording sheet, one duplex print is obtained.

p.1→p.3→p.5→p.7→p.9→p.11→<u>p.2</u>→<u>p.4</u>→<u>p.6</u>→<u>p.8</u>→<u>p.10</u>→<u>p.12</u>

(B) Interleave mode

The interleave mode is shown in FIG. 6

The first page (p.1) of the document is printed on the front side (first side) of the first recording sheet, and then odd numbered pages 3 through 7 are sequentially printed on the front sides of the second through fourth recording sheets until the number of recording sheets located in the image forming portion (b) and the paper paths (c) (d) and (e) becomes equal to the predetermined scattering sheet number (which is equal to 4 in this case) (steps 2 through 5).

After that, the second page (p.2) of the document is printed on the back side of the first recording sheet. Then the printing with respect to the front side of the recording sheet and the printing with respect to the back side of the recording sheet are alternately made. That is, the ninth page (p.9) is printed on the front side of the fifth recording sheet, the fourth page (p.4) is printed on the back side of the second recording sheet and the eleventh page (p.11) is printed on the front side of the sixth recording sheet. The recording sheets on which the printing with respect to both sides has been finished are stacked on the ejection portion (f) (steps 6 through 9).

Thereafter, the printings with respect to the back sides of the remaining recording sheets are successively made. That is, the even numbered pages 6 through 12 are printed on the back sides of the third through sixth recording sheets and then the recording sheets on which the printings with respect to both sides thereof have been finished are stacked on the ejection portion (f) (steps 10 through 14). As a result, six recording sheets having images formed on both sides thereof (six duplex prints) are obtained.

In other words, the printing takes place in the following sequence.

p.1→p.3→p.5→p.7→<u>p.2</u>→p.9→<u>p.4</u>→p.11→<u>p.6</u>→<u>p.8</u>→<u>p.10</u>→<u>p.12</u>

(C) Flying mode

The flying mode is shown in FIG. 7.

In the flying mode, the printings are made with respect to both sides of the recording sheets whose number in one printing job is equal to the scattering sheet number.

As shown in FIG. 7, the odd numbered pages 1 through 7 are sequentially printed on the front sides of the first through fourth recording sheets so that the number of the recording sheets are located in the image forming portion (b) and the paper path (c) (d) and (e) becomes equal to the scattering sheet number (which is equal to 4 in this case) (steps 2 through 5). Then, the even numbered pages 2 through 8 are sequentially printed on the back sides of the first through fourth recording sheets which are separately located in the image forming portion (b) and the paper paths (c) (d) and (d) and have the images formed on the front sides thereof. The recording sheets having the images formed on both sides thereof are respectively ejected from the paper path (e) and stacked on the ejection portion (f) (steps 6 through 9).

When the printing is finished for both sides of all the recording sheets located in the paper paths so that the first printing job is finished, the second job is started. That is, the ninth page (p.9) is printed on the front side of the fifth recording sheet and the eleventh page (p.11) is printed on the front side of the sixth recording sheet. Then, the tenth page (p.10) is printed on the back side of the fifth recording sheet and the twelfth page (p.12) is printed on the back side of the sixth recording sheet. In the second job, two duplex prints are obtained. When the number of the remaining recording sheets is less than the scattering sheet number, the printings with respect to both sides of the remaining recording sheets are made in one printing job (steps 10 through 16)

In other words, the printing takes place in the following sequence.

p.1 → p.3 → p.5 → p.7 → p.2 → p.4 → p.6 → p.8 (one job: 4 recording sheets) → p.9 → p.11 → p.10 → p.12 (one job: 2 recording sheets).

(D) Through mode

Figure 8:
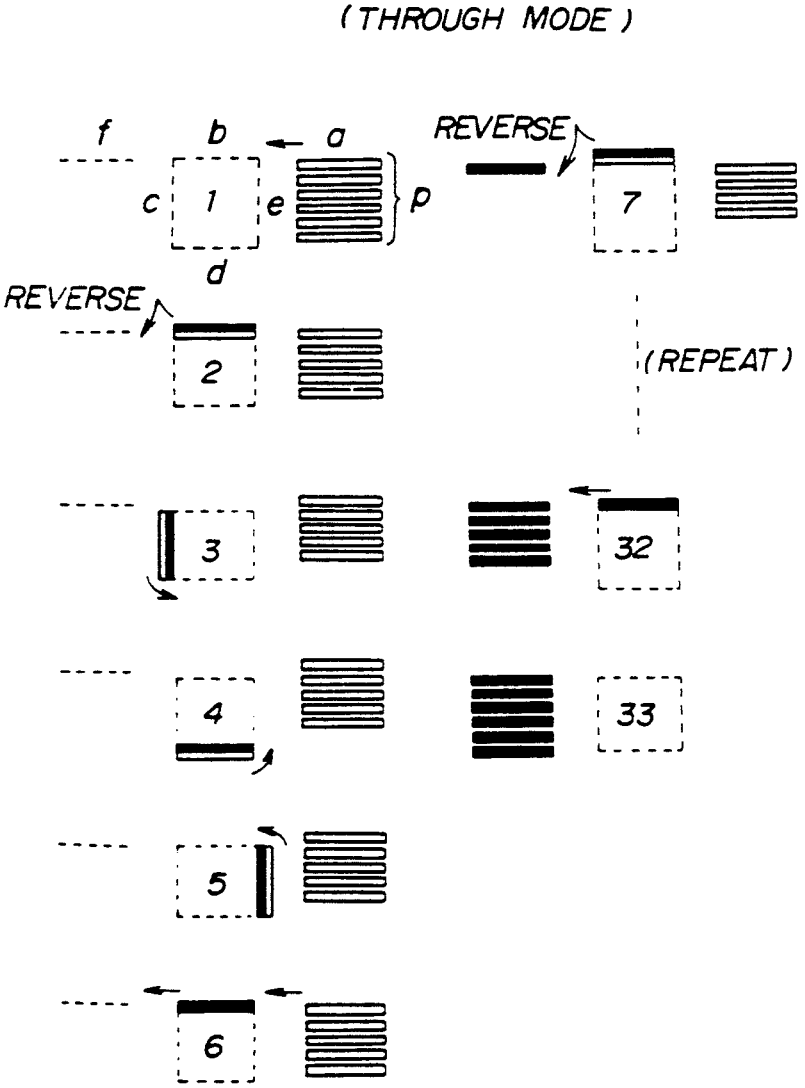

The through mode is shown in FIG. 8.

The conventional copy machine generally makes the duplex prints in the through mode. The printing (copying) with respect to both sides of one recording sheet is made in one printing job, in the through mode.

As shown in FIG. 8, first the first page (p.1) is printed on the front side of the first recording sheet (step 2), and then the second page (p.2) is printed on the back side of the first recording sheet (step 6). After the printing is finished for both sides of the first recording sheet, the printing with respect to the front side of the second recording sheet is started (step 7). When the printing is made for both sides of a plurality of the recording sheets, the sequence as described above is repeated. That is, the printing takes place in the following sequence.

p.1 → p.2 → p.3 → p.4 → p.5 → p.6 →
(1st sheet) (2nd sheet) (3rd sheet)

-continued p.7 → p.8 → p.9 → p.10 → p.11 → p.12
(4th sheet) (5th sheet) (6th sheet)

Figure 2:
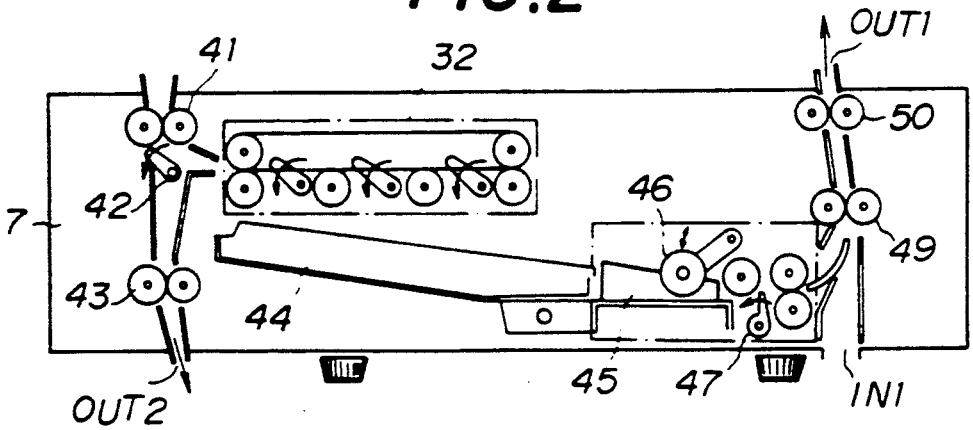
FIG. 2 is a diagram illustrating a duplex unit show in FIG. 1

In the interleave mode, the recording sheet which has an image formed on the front side thereof is supplied to the duplex unit 7 shown in FIG. 2 and is aligned on the intermediate tray 44 by the guide plates 62 shown in FIG. 3. The operation up to this point is basically the same as that of the stack mode described above. However, in the interleave mode, a second recording sheet is supplied after the first recording sheet is aligned, but this second recording sheet is not stacked on top of the first recording sheet. In a state where the guide plates 62 are positioned to align the first recording sheet, a paper supply clutch, a pickup solenoid and the like are turned ON to carry out a preparatory paper supply process for a predetermined time until a paper supply instruction is received. Such a preparatory paper supply process is carried out to ensure the correct alignment of the second recording sheet even when the interval between the first and second recording sheets becomes small. The paper supply clutch, the pickup solenoid and the like are turned ON in response to the paper supply instruction. Thereafter, the guide plates 62 are separated from each other with a timing such that the first recording sheet is sufficiently pinched by the intermediate rollers 49, so that the incoming second recording sheet does not hit the guide plates 62. The above described operation, is repeated for each of the remaining recording sheets.

The stopper 47 is switched to the second position when the preparatory paper supply process is started. The stopper 47 returns to the first position when a paper end sensor (not shown) no longer detects the recording sheet which is supplied by the preparatory paper supply process. The guide plates 62 do not move until the recording sheet reaches the intermediate rollers 49, and for this reason, none of the recording sheets supplied is skewed.

Figure 9A:
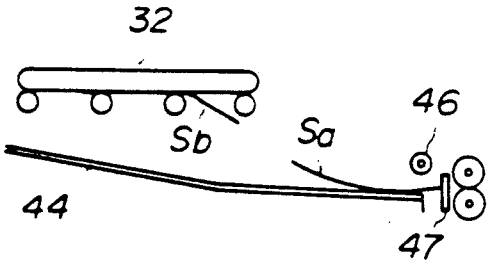
FIGS. 9A, 9B and 9C are diagrams illustrating a state where the recording sheets are moved in the duplex unit.
Figure 9B:
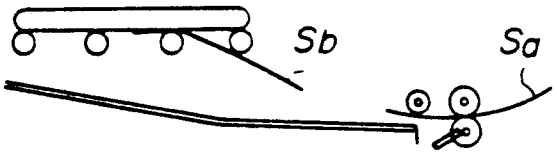
Figure 9C:
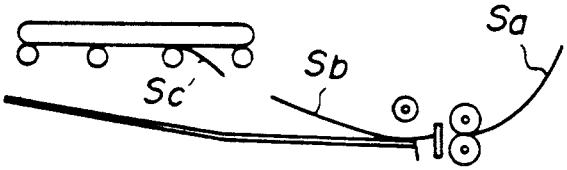

FIGS. 9A, 9B and 9C respectively show positions of recording sheets Sa, Sb, and Sc within the duplex unit 7 at different stages of the paper supply process.

Figure 10:
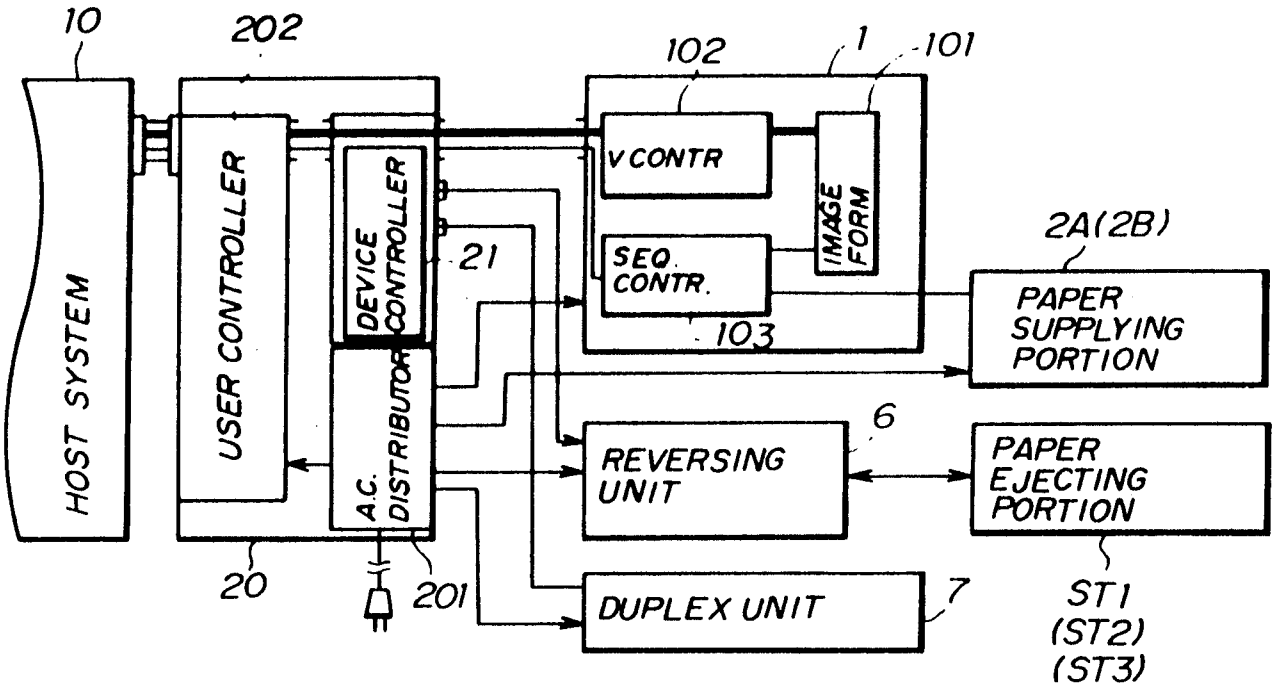
FIG. 10 is a block diagram illustrating a control system of the laser beam printer shown in FIG. 1.

A description will now be given of a structure of the control system of the laser beam printer system. FIG. 10 is a block diagram illustrating the control system of the laser beam printer system. In FIG. 10, those parts which are the same as those corresponding parts in FIG. 1 are designated by the same reference numerals, and a description thereof will be omitted.

Referring to FIG. 10, the controller unit 20 includes a device controller 21, an A.C. distributor unit 201 and a user controller 202 which is coupled to a host system 10 such as a word processing unit or a personal computer. The main printer body 1 includes an image forming portion 101, a video controller 102 and a sequence controller 103. The video controller 102 receives the image data from the host system 10 via the user controller 202 and the device controller 21 and controls the laser write unit in the image forming portion 101 on the basis of the image data. The sequence controller 103 drives a motor, a solenoid, a clutch and the like for controlling various parts of the main printer body 1 such as the parts for supplying the recording sheets, forming the images, transporting the recording sheets and ejecting the recording sheets. The sequence controller 103 also controls a high voltage source of the main printer body 1 for supplying a high voltage to various chargers.

In this laser printer system, the duplex prints are obtained in accordance with the sequence of steps shown in the flow charts in FIGS. 11A, 11B, 11C, 11D and 11E.

Figure 11A:
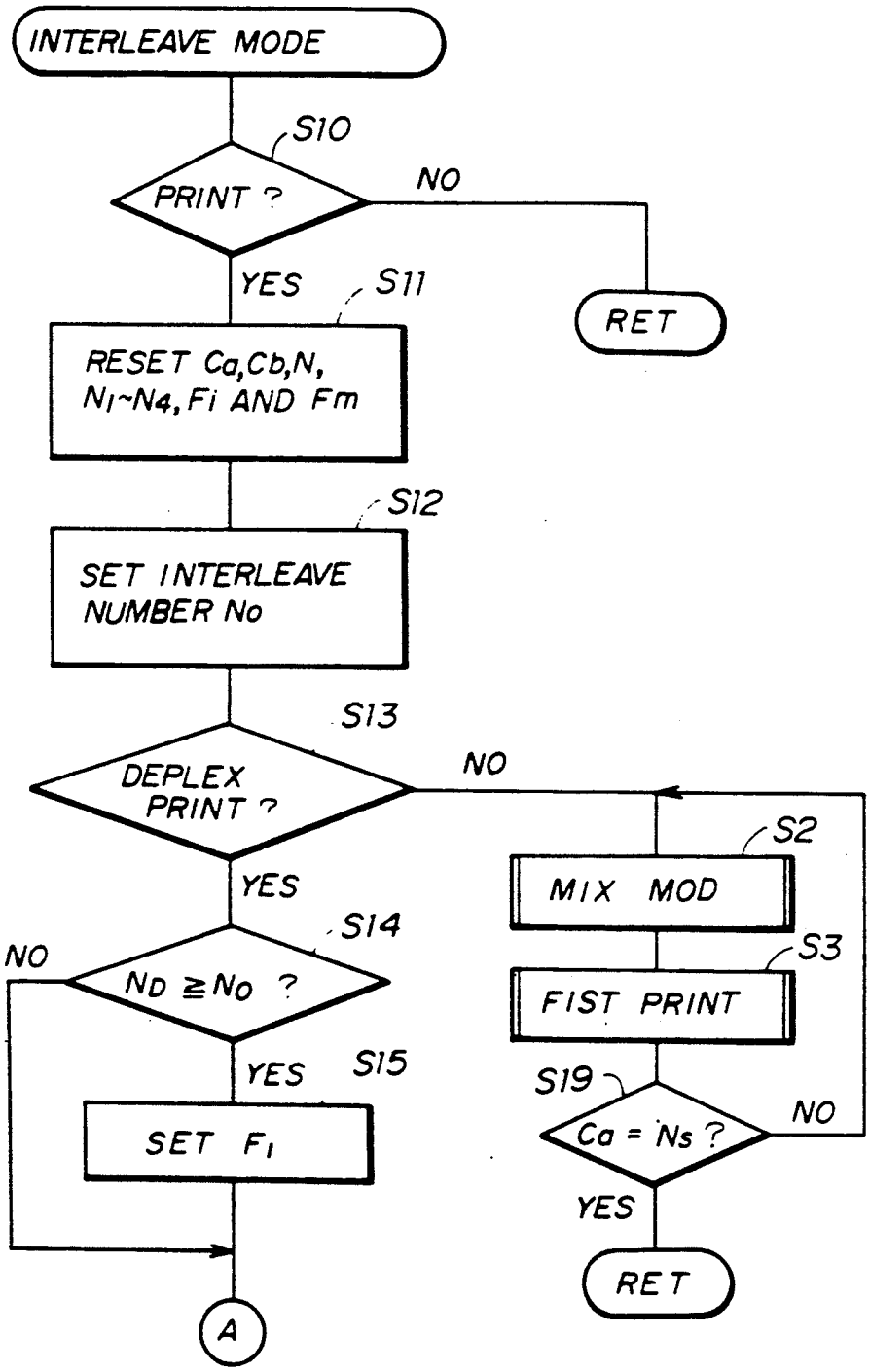
FIGS. 11A, 11B, 11C, 11D, 11E are flow charts illustrating a first embodiment of processes for making the duplex prints in an interleave mode.
Figure 11B:
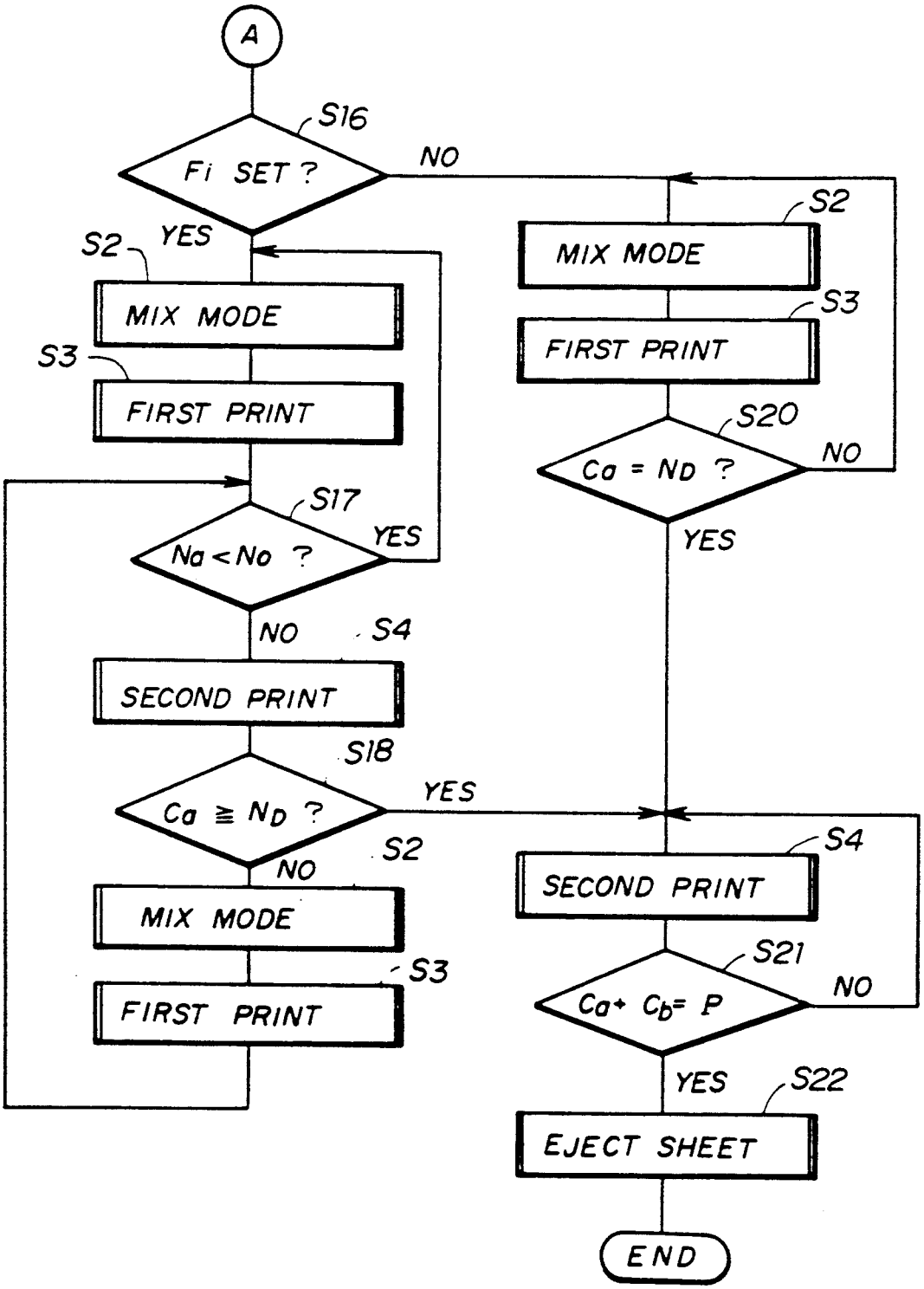

In FIGS. 11A and 11B, when the operation in the interleave mode (S1) starts, step S10 determines whether or not a print command is received. When the result in step S10 is YES, step S11 resets counters Ca, Cb, N, N1, N2, N3 and N4 and flags Fi and Fm. The counter Ca counts the number of recording sheets each having an image formed on the first side thereof. The counter Cb counts the number of recording sheets each having an image formed on thereof during a duplex print mode. Step S12 sets the interleave number No to a predetermined value depending on the length of the recording sheet along the transport direction, the intervals between the recording sheets, the length of the transport path and the like. The interleave number is the number of recording sheets which are capable of being located in the transport path with a non-stacked arrangement.

Step S13 determines whether or not the print mode is the duplex mode. When the result obtained in step S13 is YES, a step S14 determines whether or not the total number of duplex prints $N_D$ is equal to or greater than the interleave number No ($N_D \geqq No$). When the result in step S14 is YES, step S15 sets the interleave flag Fi.

The relationship between the number of total duplex prints $N_D$ and a total number of document pages P in the duplex mode can be described by the formula (1) for the even numbered document pages and by the formula (2) for the odd numbered document pages.

$$N_D = P/2 \ (P = 2(n+1),\ n = 0, 1, 2, \ldots) \quad (1)$$

$$N_D = (P+1)/2 \ (P = 2n+1,\ n = 0, 1, 2, \ldots) \quad (2)$$

Step S16 determines whether or not the interleave flag Fi is set. When the result in step S16 is YES, step S2 carries out a mix mode process shown in FIG. 11C and then step S3 carries out a first print process shown in FIG. 11D. Then, step S17 determines whether or not the number N of recording sheets which are located in the transport path is less than the interleave number No. When the result in step S17 is YES, the process returns to step S2. Until the result in step S17 becomes NO, the mix mode process in step S2 and the first print process in step S3 are repeatedly carried out. In other words, the recording sheets are supplied from the cassette to the main printer body 1 and the images are successively formed on the first sides of the recording sheets until the number N of the recording sheets which are located in the transport path becomes equal to the interleave number No. For example, when the interleave number No is set to 4, four first odd pages p.1, p.3, p.5 and p.7 are printed on the first sides of the recording sheets.

Figure 11C:
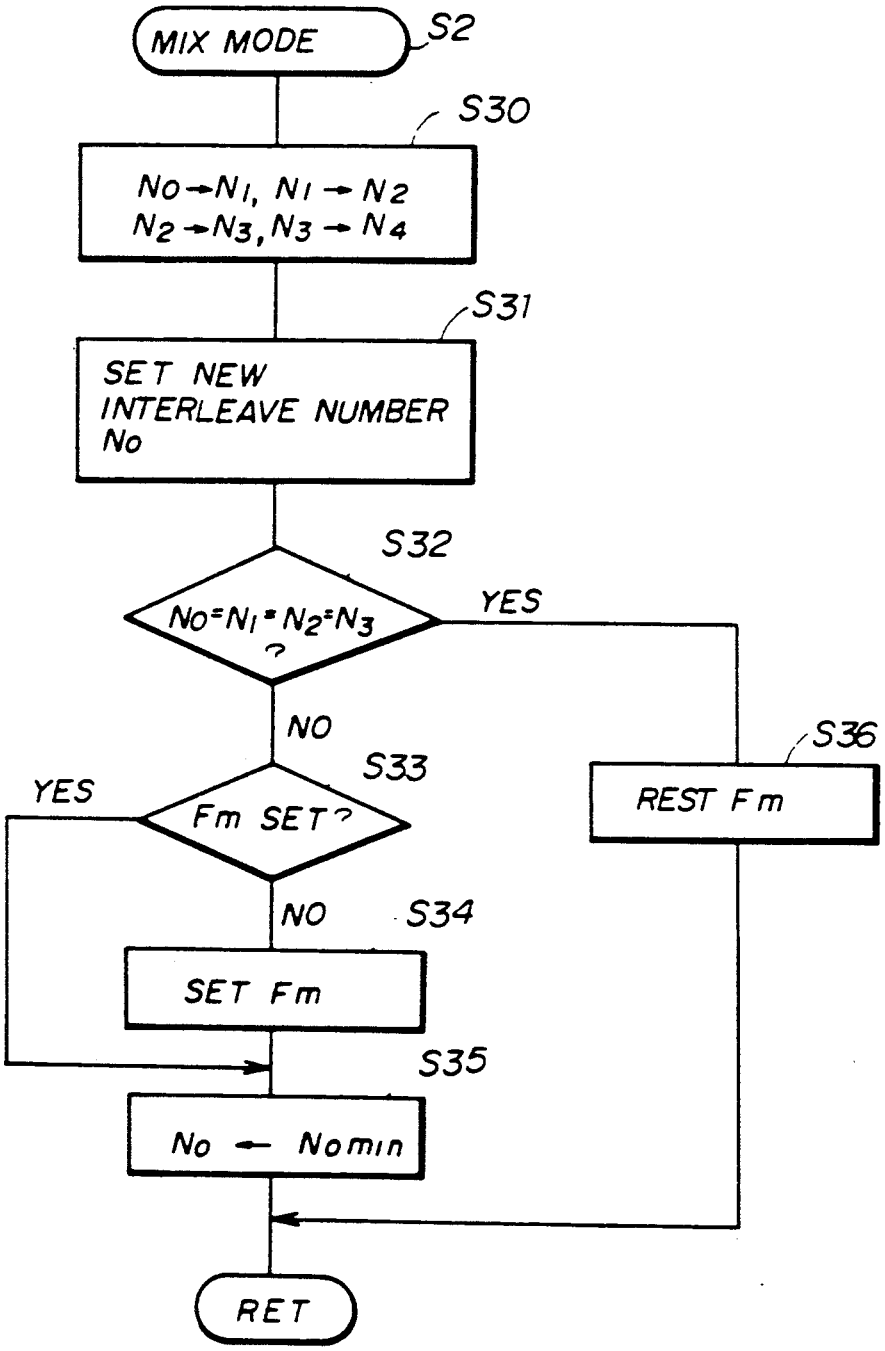
Figure 11D:
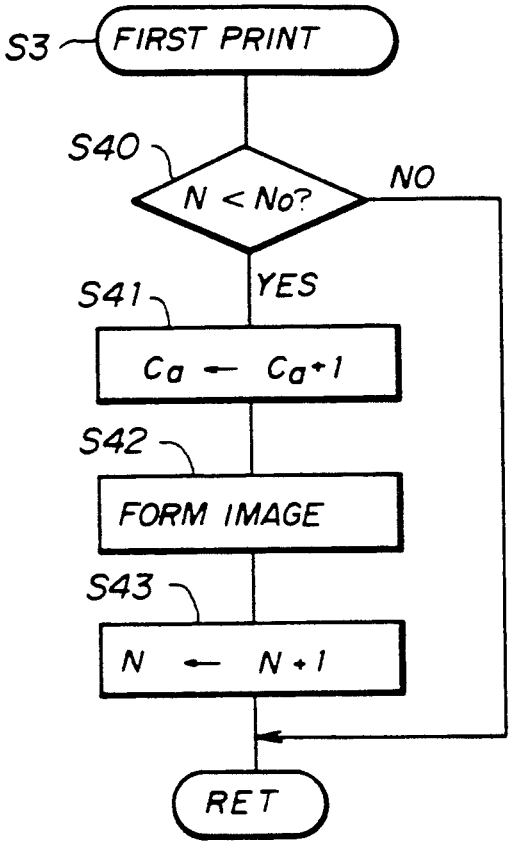

Step S3 carries out the first print process as shown in FIG. 11D. In FIG. 11D, step S40 determines whether or not the number N of the recording sheets which are located in the transport path is less than the interleave number No. When the result in step S40 is YES, step S41 increments the count in the counter Ca and then step 42 forms an image on the first side of the recording sheet which is supplied from the cassette to the main printer body 1. After that, step 43 increments the count in the counter N. The count in counter N is equal to the number of the recording sheets which are located in the transport path. In the first print process, when the result in step S40 is NO, the first print process is finished.

Figure 11E:
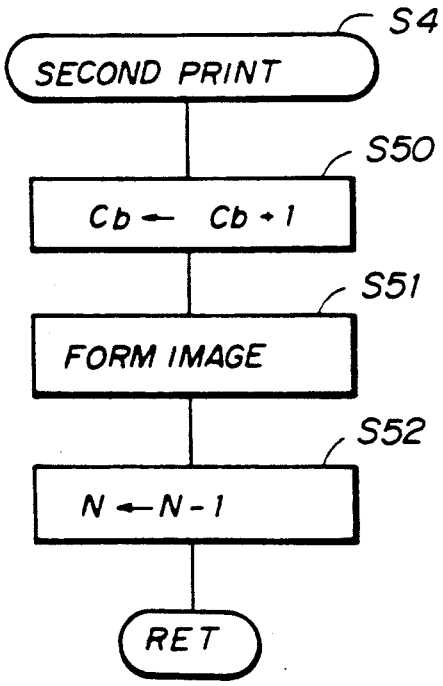

When the result in step S17 is NO, step S4 carries out the second print process shown in FIG. 11E. In FIG. 11E, step S50 increments the count in the counter Cb and step 51 makes the print with respect to the second side of each recording sheet having the image formed on the first side thereof. Then step 52 decrements the count in counter N.

When the second print process in step S4 is finished, step S18 determines whether or not the count in counter Ca is equal to or greater than the total number $N_D$. When the result in step S18 is NO, the step S2 carries out the mix print mode process and the step S3 carries out the first print process. And then the process returns to step S17. Until the count in counter Ca becomes equal to the total number $N_D$ of the duplex prints, the mix mode process in step S2, the first print process in step S3 and the second print process in step S4 are repeatedly carried out. In other words, the print with respect to the first side of the recording sheet and the print with respect to the second side of the recording sheet having the image formed on the first side thereof are alternatively made. For example, the second page p.2 is printed on the second side of the recording sheet having the image of the first page p.1 formed on the first side thereof, and then the ninth page p.9 is printed on the first side of the recording sheet which is supplied from the cassette. After that, the fourth page p.4 is printed on the second side of the recording sheet having the image of the third page p.3 formed on the first side thereof, and then the eleventh page p.11 is printed in the first side of the recording sheet which is supplied from the cassette.

When the printing process ends for the first side of each of the recording sheets, the result in step S18 becomes YES. In this case, step S4 carries out the second print process shown in FIG. 11E, and step 21 determines whether or not Ca+Cb=P. P denotes a total number of pages to be printed. When the result in step S21 is NO, the process returns to the second print process in step S4. Then, the second print process in step S4 is repeatedly carried out until Ca+Cb becomes equal to P. For example, the sixth page p.6 is printed on the second side of the recording sheet having the image of the fifth page p.5 formed on the first side thereof, the eighth page p.8 is printed on the second side of the recording sheet having the image of the seventh page p.7 formed on the first side thereof, the tenth page p.10 is printed on the second side of the recording sheet having the image of the ninth page p.9 formed on the first side thereof and the twelfth page p.12 is printed on the second side of the recording sheet having the image of the eleventh page p.11 formed on the first side thereof. Then, when the result in step S21 is YES (Ca+Cb=P), each of the recording sheets having an image formed on both sides thereof is ejected from the main printer body 1. If the odd numbered pages are printed in the duplex mode, the image is not printed on the second side of the last recording sheet.

On the other hand, when the interleave flag Fi is not set, the result in step S16 is NO. In this case, the mix mode process in step S2 as shown in FIG. 11C and the first print process in step S3 as shown in FIG. 11D are carried out, and then step S20 determines whether or not the count number in the counter Ca is equal to the total number of the duplex prints $N_D$. When the result in step S20 is NO, the process returns to the mix mode process in step S2. Then, the mix mode process in step S2 and the first print process in step S3 are repeatedly carried out until the counter number in counter Ca which is incremented in the first print process (S3) becomes equal to the total number of the duplex prints $N_D$. In other words, the images are successively formed on the first sides of $N_D$ recording sheets. When the result in step S20 is YES, the process advances to the second side print in step S4. That is, when $N_D$ recording sheets having the images formed on the first sides thereof are obtained, the process advances to the second side printing in step S4. Then, step S4 and step S21 carry out the printings with respect to the second side of the recording sheets which have already had images formed on the first sides thereof. When Ca+Cb=P, the $N_D$ recording sheets which have images formed on both sides thereof are ejected from this laser beam printer system (S22).

When the result in step S13 is NO, step S2 carries out the mix mode process shown in FIG. 11C, step S3 carries out the first print process shown in FIG. 11D, and then step S19 determines whether or not Ca is equal to Ns. In this one-sided print mode, the printing is made with respect to the first sides of the recording sheets until the counter Ca becomes Ns, where Ns indicates the total number of prints (that is, pages) to be made in the one-sided print mode.

In the duplex print mode and the one-sided print mode described above, the mix mode process in step S4 is carried out as shown in FIG. 11C. The mix mode process is effective when different sized recording sheets are supplied to the main printer body 1. For example, in this laser beam printer system, the maximum interleave number No is 4. The interleave number No is set to the maximum interleave number 4 when the duplex prints are made on A4 sized recording sheets, the interleave number No is set to 3 when the duplex prints are made on B4 sized recording sheets, and the interleave number No is set to 2 when the duplex prints are made on A3 sized recording sheets.

The interleave number No is previously determined with respect to each recording sheet size so that the recording sheets transported in the transport path do not overlap each other.

In FIG. 11C, step S30 sequentially shifts the interleave number No which has been set and count numbers in counter N1, N2, N3 and N4 in this order. That is, the interleave number No is shifted to the counter N1 (No→N1), the count number in the counter N1 is shifted to the counter N2 (N1→N2), the count number in counter N2 is shifted to the counter N3 (N2→N3) and the count number in the counter N3 is shifted to the counter N4 (N3→N4). Step S31 sets a new interleave number No at a value corresponding to the length of the recording sheet along the transport direction, which recording sheet is supplied to the main printer body 1. Step S32 determines whether or not the new interleave number No and the count values in the counters N1, N2 and N3 are equal to each other. When at least one of numbers of No, N1, N2 and N3 differs from the others, the result in step S32 is NO. In this case, the step S33 determines whether or not the mix mode flag is set. When the result in step S33 is NO, step S34 sets the mix mode flag, and then step S35 changes the interleave number No into a minimum value corresponding to the largest sized recording sheet out of the recording sheets which are capable of being supplied to this laser printer system. In this embodiment, a minimum interleave number $No_{min}$ corresponds to the A3 recording sheet is 2 ($No_{min}=2$), this number being the minimum value of the interleave number. When the result in step S33 is YES, the process immediately advances to step S35.

On the other hand, when the interleave number No and the count numbers in the counter N1, N2 and N3 are equal to each other, the result in step 32S is YES In this case, the mix mode flag Fm is reset.

A description will now be given of a concrete process in a case where the size of the recording sheet is changed from A4 to B4. The interleave number No corresponding to the A4 sized recording sheet is 4. That is, the 4 recording sheets which have images formed on the first sides thereof are located in the transport path during the duplex prints are made on the A4 sized recording sheets. The interleave number No corresponding to the B4 sized recording sheet is 3. That is, 3 recording sheets each having an image formed on the first side thereof are located in the transport path when the duplex prints are made on the B4 sized recording sheets.

When an image is successively formed on the first sides and the second side of each A4 sized recording sheet, the interleave number No and the count numbers in the counter N1, N2 and N3 are equal to each other. That is, No=N1=N2=N3=4. Therefore, in the mix mode process in step S2, a state where the mix mode flag Fm is not set is maintained. When a B4 sized recording sheet is supplied to this laser beam printer system, the new interleave number No is set to 3. Thus, the interleave number No differs from each of the count numbers N1, N2, and N3, and then the mix mode flag Fm is set. After that, the interleave number No (=3) is changed to the minimum interleave number Nomin which is equal to 2.

After that, the mix mode process shown in FIG. 11C and the second print process shown in FIG. 11E are carried out, but the first print process shown in FIG. 11D is not carried out. Therefore, the number N of the recording sheets which are located in the transport path decrements when the second print process is carried out. Then, the first print process is not carried out until the number N of the recording sheets becomes less than the minimum interleave number $No_{min}$. That is, when the number N of the recording sheets which are located in the transport path becomes 1, which is less than the minimum interleave number Nomin=2, the first print process with respect to each B4 sized recording sheet is started.

In addition, in the mix mode process, when the interleave number is set to 3 corresponding to the B4 recording sheet and the count numbers N1, N2, and N3 are equal to each other, the mix mode flag Fm is reset. The interleave number No which is equal to 3 corresponding to the B4 sized recording sheet is not, changed into the minimum interleave number Nomin=2. Thus, since the number N of the recording sheets which are located in the transport path is less than the interleave number No (=3), the first print process with respect to the B4 sized recording sheet is carried out in steps S17, S2 and S3. When the number N of the recording sheets which are located in the transport path is equal to the interleave number No (=3), the second print process and the first print process with respect to the B4 sized recording sheet are alternatively carried out.

The above described procedure is carried out by a first controller means which is comprised of the device controller 21 shown in FIG. 10 and a second controller means for controlling the main printer body 1, the reversing, until 6, the duplex unit 7, the paper supplying unit 2A and 2B and stackers ST1,ST2 and ST3. The second controller means transmits information to and receives information from the first controller means for controlling the various parts of the laser beam printer system.

In the above described procedure in accordance with the sequence of steps shown in the flow charts in FIG. 11A, 11B, 11C and 11D, when the size of the recording sheet is changed, first, the minimum interleave number $No_{min}$ is set, which minimum interleave number $No_{min}$ corresponds to the largest recording sheet capable of being supplied to this laser beam printer system. And then, until the number of the recording sheets which are located in the transport path is equal to or less than the minimum interleave number $No_{min}$, the first print process with respect to the recording sheet having a new size is suspended. When the number of the recording sheets which are located in the transport path becomes equal to the minimum interleave number $No_{min}$, the first print process is repeatedly carried out. Then after the number of the recording sheets which are located in the transport path becomes equal to the interleave number No corresponding to the recording sheet having the new size, the second print process and the first print process are alternatively carried out so that the duplex prints are obtained.

Therefore, according to the above described embodiment, as the interleave number No is set to the minimum interleave number when the size of the recording sheet which is supplied to the laser beam printer changes the recording sheets supplied to the laser beam system are prevented from overlapping with each other. In addition, as the interleave number No is always set to the minimum interleave number $No_{min}$ without determining what the size of the recording sheet is, the control with respect to the duplex print is simple when the size of the recording sheet is changed.

FIGS. 12A, 12B, 12C and 12D are flow charts illustrating another embodiment of the procedure to obtain the duplex prints.

Figure 12A:
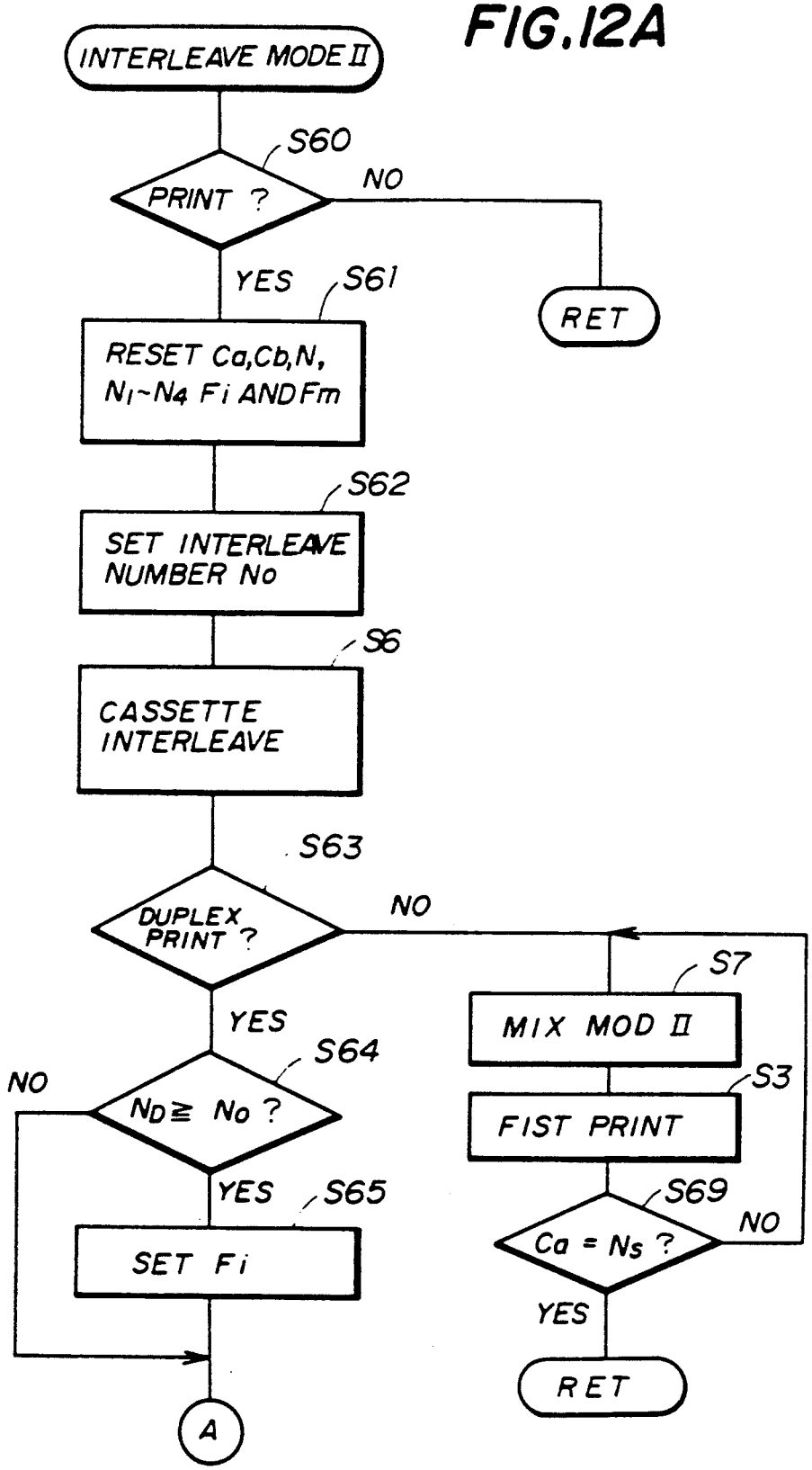
FIGS. 12A, 12B, 12C and 12D are flow charts illustrating a second embodiment of processes for making the duplex prints in the interleave mode.
Figure 12B:
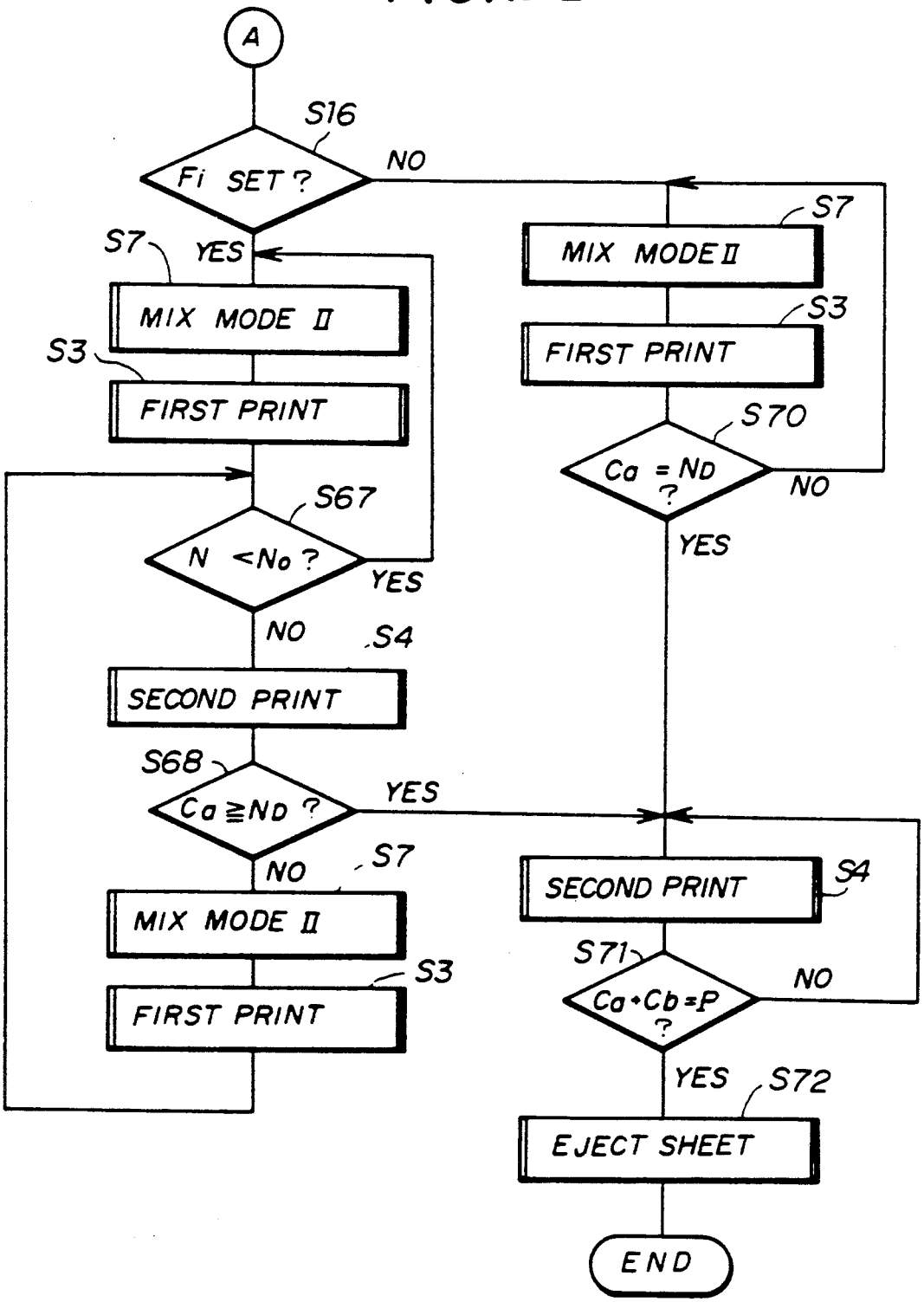

In the procedure as shown in FIGS. 12A and 12B, before step S63 determines whether or not the print mode is the duplex print mode, step S6 carries out a cassette interleave process. Step S7 carries out a mix mode (II) before the first print process in step S3. The processes other than steps S6 and S7 are identical to those in the procedure shown in FIG. 11A.

The cassette interleave process in step S6 is a process for determining a cassette minimum interleave number Noc which is the interleave number No corresponding to the largest sized recording sheet out of the recording sheets which are actually housed in the paper supplying unit including the cassettes 2A mounted to the laser beam printer system.

In this embodiment, three groups of recording sheets are previously determined. For example, a group 0 (G0) has A3 sized recording sheets and double letter sized recording sheets, a group 1 (G1) has the A4 sized recording sheets, the letter sized recording sheet and legal sized recording sheets, and a group 2 (G2) has A5 sized recording sheets and the half sized recording sheet. The interleave number corresponding to each of groups G0, G1 and G2 is determined. The interleave number $No_{GO}$ corresponds to the group 0 (G0) and is the number of recording sheets in group 0 (GO) which are capable of being located in the transport path with a non-stacked arrangement. The interleave number $No_{G1}$ corresponds to the group 1 (G1) and is the number of the recording sheets in group 1 (G1) which are capable of being located in the transport path with a non-stacked arrangement. The interleave number $No_{G2}$ corresponds to the group 2 (G2) and is the number of the recording sheets in group 2 (G2) which are capable of being located in the transport path with a non-stacked arrangement. The interleave number $No_{G0}$ corresponding to the group 0 (G0) is the smallest of the three interleave numbers $No_{G0}$, $No_{G1}$ and $No_{G2}$. The interleave number $No_{G2}$ corresponding to the group 2 (G2) is the largest of the three interleave numbers.

Figure 12C:
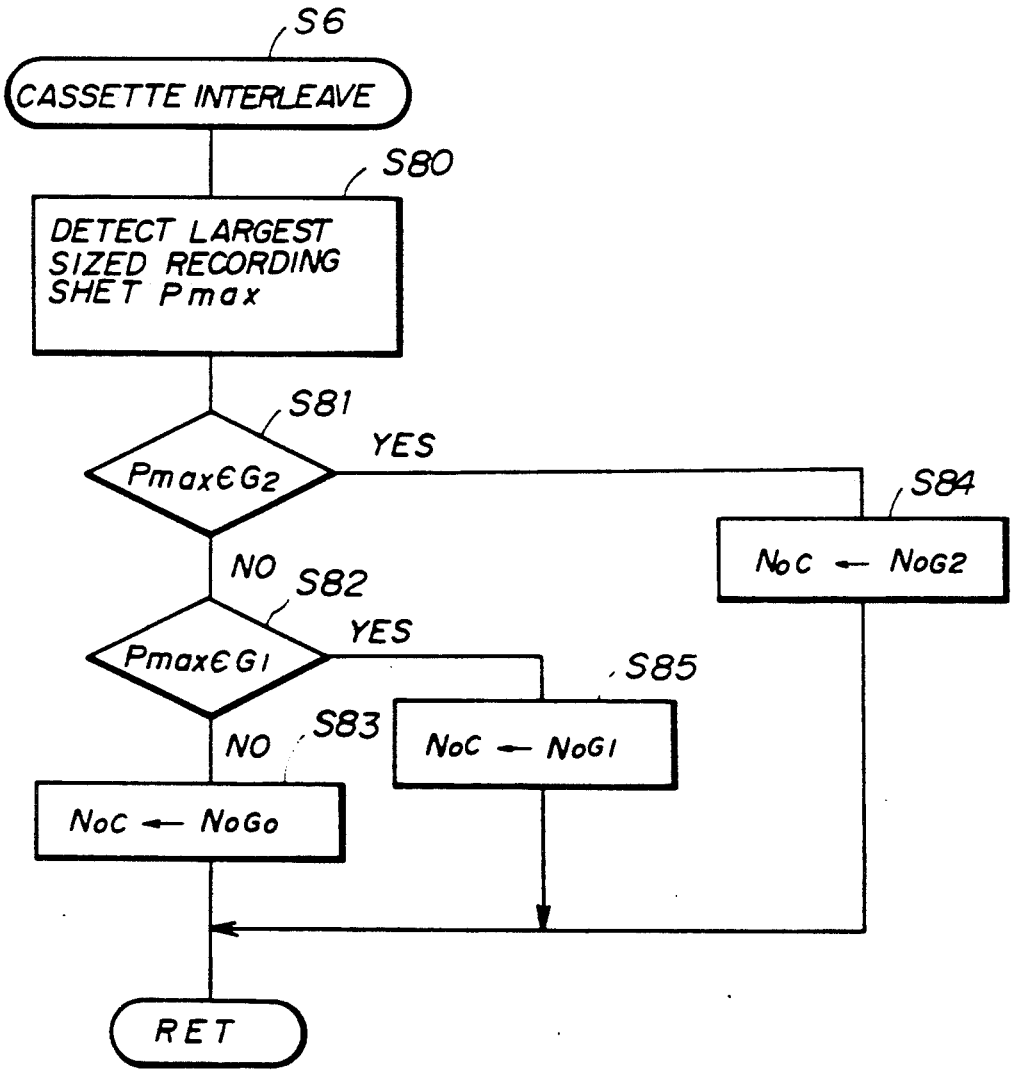
Figure 12D:
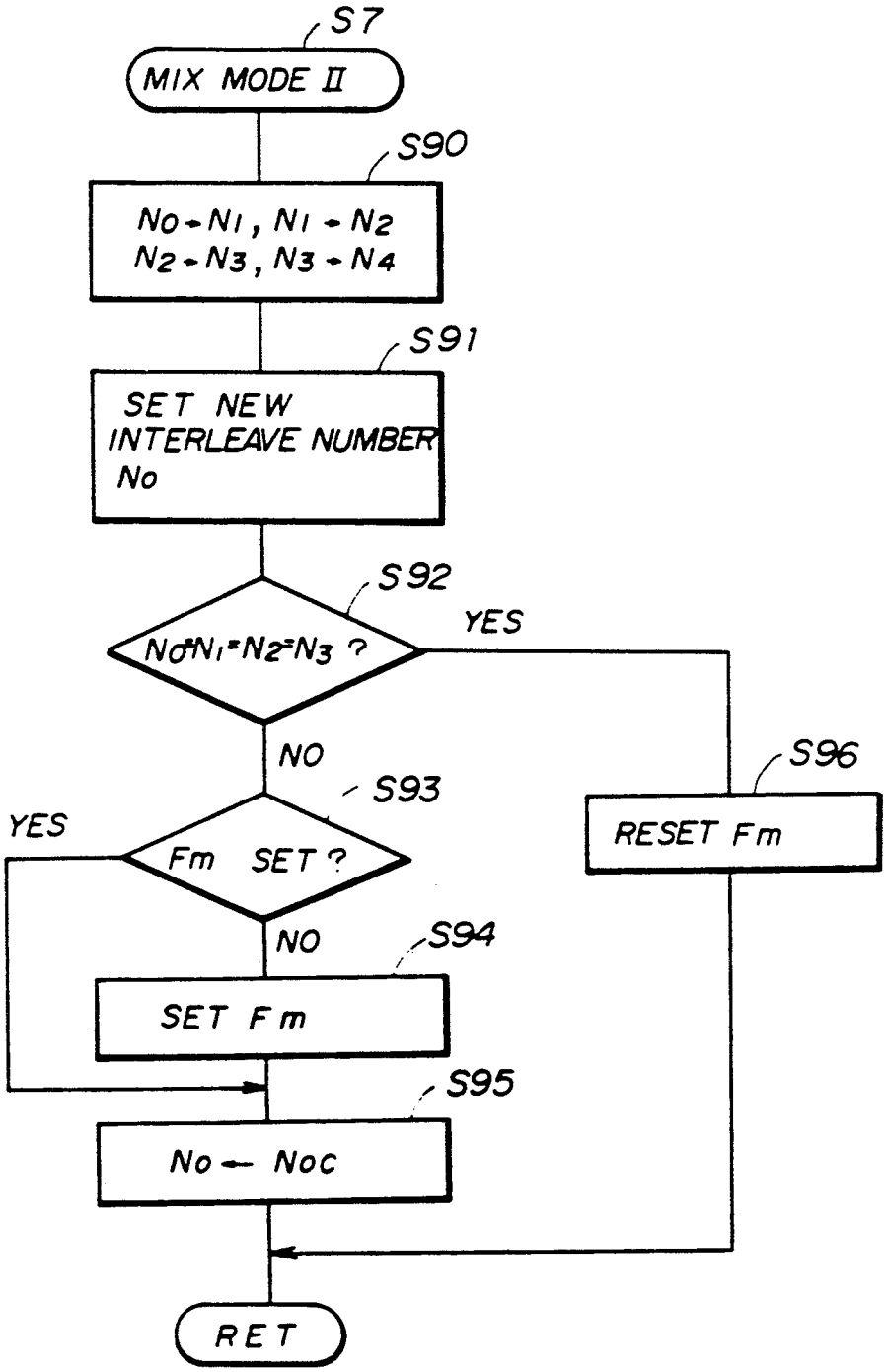

The cassette interleave process in step S6 is shown in FIG. 12C.

In FIG. 12C, step S80 detects the largest sized recording sheet $P_{max}$ of the recording sheets which are housed in the paper supplying units including the cassettes 2A. Then, step S81 determines whether or not the largest sized recording sheet $P_{max}$ is included in group 2 (G2). When the result in step S81 is YES, the cassette minimum interleave number Noc is set to the interleave number $No_{G2}$ corresponding to the group 2 (G2). When the result in step S81 is NO, step S82 determines whether or not the largest sized recording sheet $P_{max}$ is included in group 1 (G1) or not. When the result in step S82 is YES, the minimum cassette interleave number Noc is set to the interleave number $No_{G1}$ corresponding to the group 1 (G1). When the result in step S82 is NO, the cassette minimum interleave number Noc is set to the interleave number $No_{G0}$ corresponding to the group 0 (G0). For example, when the largest sized recording sheet $P_{max}$ is the legal sized recording sheet, the cassette minimum interleave number Noc is set to the interleave number $No_{G1}$ corresponding to the group 1 (G1).

In the mix mode (II) in step S7, when the mix mode flag Fm is set, step S95 changes the interleave number No into the cassette minimum interleave number Noc which is determined in the manner described above. The processes other than step S95 in the mix mode (II) are identical to those in the mix mode shown in FIG. 11C.

In the above described procedure in accordance with the sequence of steps shown in the flow charts in FIGS. 12A, 12B, 12C and 12D, when the size of the recording sheet is changed, first, the interleave number No is set to the minimum cassette interleave number Noc corresponding to the group including the largest sized recording sheet of the recording sheets which are housed in the paper supplying unit including the cassettes 2A.

Therefore, according to the above described embodiment, as the interleave number No is set to the cassette minimum interleave number when the size of the recording sheet which is supplied to the laser beam printer is changed, the recording sheets supplied to the laser beam system are definitely prevented from overlapping with each other. In addition, as the interleave number is always set to the cassette minimum interleave number Noc without determining what the size of the recording sheet is, the control with respect to the duplex print is when the size of the recording sheet changes. Further more, even if the size of the recording sheet changes, duplex prints are relatively rapidly obtained.

Figure 13A:
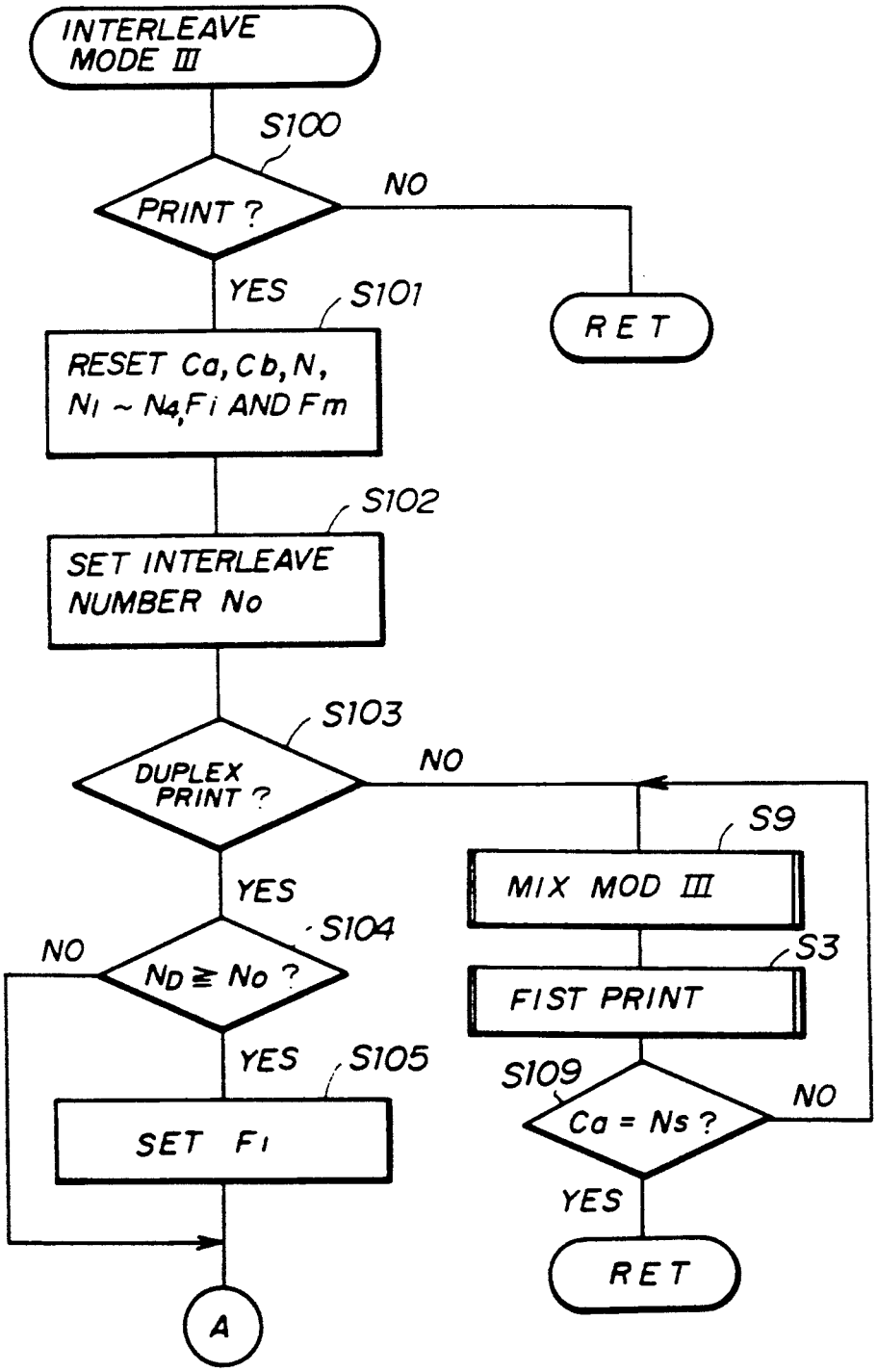
FIGS. 13A, 13B and 13C are flow charts illustrating a third embodiment of processes for making the duplex prints in the interleave mode.
Figure 13B:
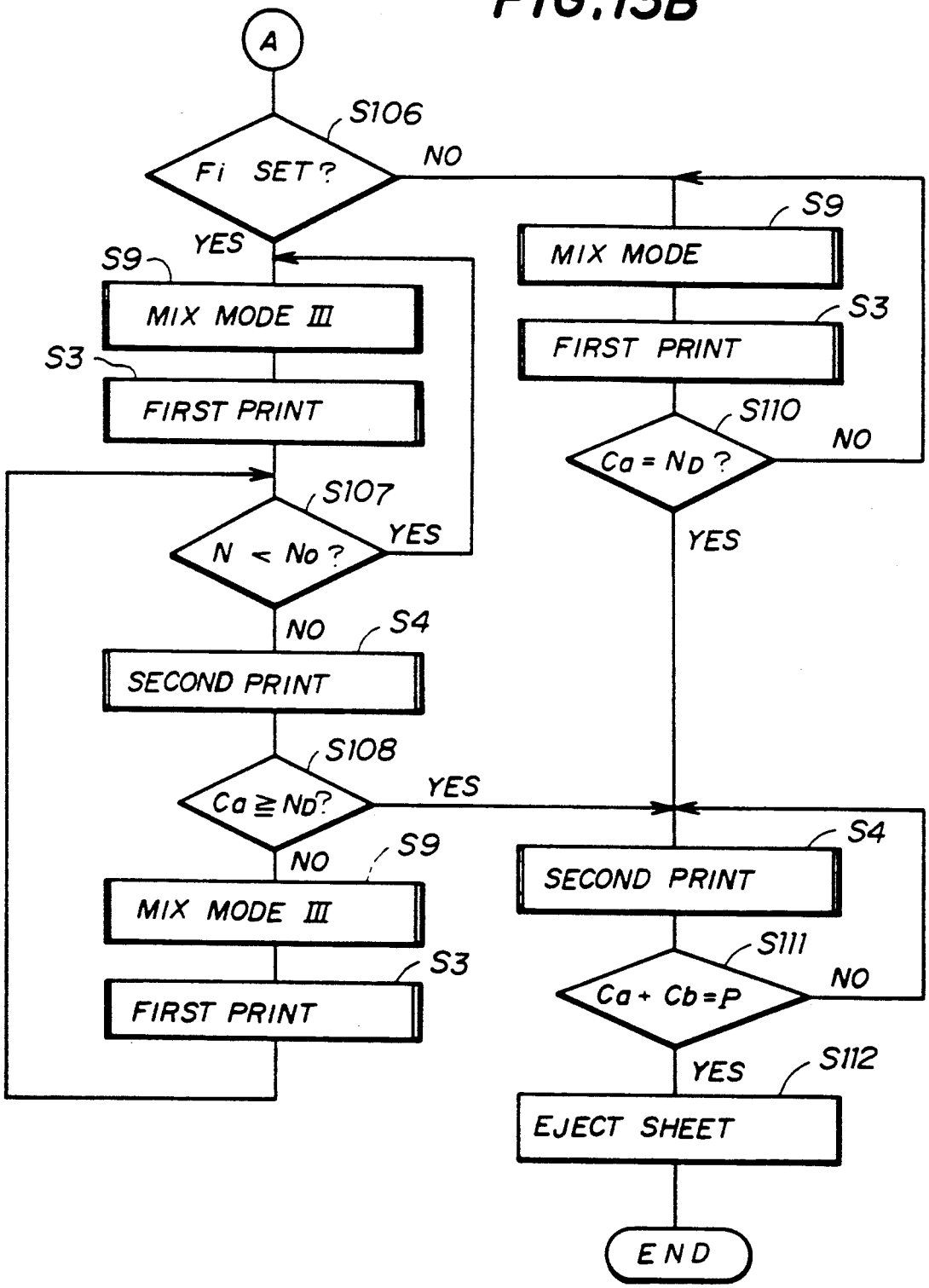
Figure 13C:
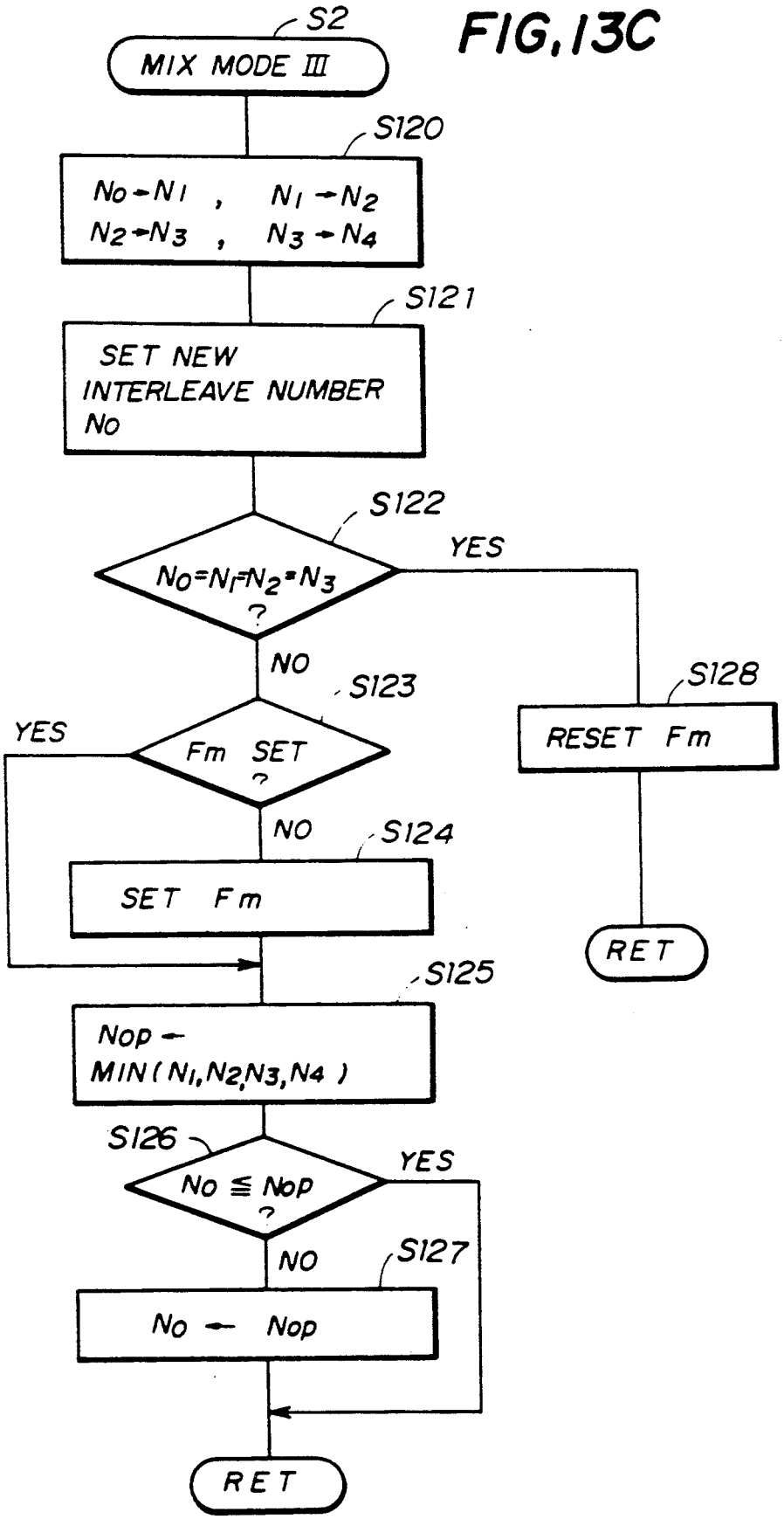

FIGS. 13A, 13B and 13C are flow charts illustrating another embodiment of the procedure to obtain the duplex prints.

In the procedure as shown in FIGS. 13A and 13B, step S9 carries out a mix mode (III) before the first print process in step S3. The processes other than steps S9 are identical to those in the procedure shown in FIG. 11A.

The mix mode process (III) is shown in FIG. 13C.

In FIG. 13C, when the mix made flag Fm is set, step S125 detects the smallest number Nop of the numbers N1, N2, N3 and N4. The smallest number Nop is the interleave number corresponding to the largest sized recording sheet of the recording sheets which have been supplied to the transport path within this laser beam printer system. Step S126 determines whether or not the interleave number No which is set in step S121 on the basis of the size of the supplied recording sheet is equal to the smallest number Nop. When the result in step S126 is NO, step S127 changes the minimum interleave number No into the smallest number Nop. Then, the duplex printing process is carried out when the minimum interleave number No is equal to the smallest number Nop. When the interleave number No, which is set in step S121, corresponding to the supplied recording sheet is equal to the smallest number which is detected in step S125, the result in step S126 is YES. In this case, the size of the last recording sheet supplied to the transport path is equal to the size of the largest sized recording sheet of the recording sheets which are located in the transport path. Thus, the interleave number No corresponding to the supplied recording sheet is not changed In the above described procedure in accordance with the sequence of steps in the flow charts in FIGS. 13A, 13B and 13C, when the size of the recording sheet is changed, first, the interleave number No is set to the smallest number Nop corresponding to the largest sized recording sheet of the new sized recording sheet and the recording sheets which have been supplied to the transport path within the laser beam printer system.

Therefore, according to the above described embodiment, as the minimum interleave number is set to the smallest number corresponding to the largest sized recording sheet when the size of the recording sheet which is supplied to the laser beam printer changes, the recording sheets supplied to the laser beam system are prevented from overlapping with each other. In addition, even if the size of the supplied recording sheet changes a duplex printing is effectively carried out. Thus, duplex prints are relatively rapidly obtained.

According to the interleave mode, the printing on the first side and the printing on the second side are alternatively made, and the alignment and refeeding of the recording sheets are successively made one recording sheet at a time. For this reason, it is possible to make duplex prints even when the size of the recording sheets differs between two successive recording sheets. Furthermore, it is possible to prevent a paper jam which often occurs when two recording sheets are simultaneously refed one on top of the other, since the recording sheets which have images printed on one side thereof are not stacked as in the case of the conventional laser beam printer system employing the stack mode. On the other hand, even if a paper jam should occur during the duplex print mode due to some reason, it is extremely easy to recover the page contents because the number of recording sheets existing in the transport path within the laser beam printer system is relatively small.

When making successive prints in the interleave mode, a delay in processing image data, a delay in transmitting the image data and other delays generated in an image processing controller (the host system and/or the video controller) are generated in units of pages in most cases. When such a delay is generated, it is necessary to temporarily stop the recording sheets in the transport path except for those recording sheets located at the printing and fixing parts, and wait until the delay is absorbed. After the delay is absorbed, the printing is resumed by transporting the recording sheets. Such a mode in which, the transport of the recording sheets is temporarily stopped to absorb the delay generated in the image processing controller will hereinafter be referred to as a stoppable mode.

A description will now be given of the stoppable mode. When the delay is generated in the image processing controller, the conventional laser beam printer system waits until the delay is absorbed by stacking the recording sheets on the intermediate tray. But in the stoppable mode of the interleave mode, it is impossible to stack the recording sheets. For this reason, the paper transport members such as the rollers of the duplex unit 7 are stopped. As a result, the recording sheets are stopped in the transport path within the duplex unit 7 until the above described delay is absorbed As one method of stopping the paper transport member of the duplex unit 7, it is possible to provide a solenoid clutch between the paper transport member and a driving motor. In the following description, it is assumed that this method is used to stop the paper transport member.

As described above, the laser beam printer system shown in FIG. 1 makes the print by transporting the recording sheet by the registration rollers 3 in synchronism with the toner image which is formed on the photosensitive drum 4 based on the image data which is received via the device controller 21 and transferring the toner image onto the recording sheet.

In order to absorb the delay in the transmitted image data in this case, the recording sheet should be stopped at the position of the registration rollers 3. However, when the transport of only the recording sheet located at the registration rollers 3 is stopped, the other recording sheets existing within the transport path of the laser beam printer system will catch up with the recording sheet which is stopped at the registration rollers 3 and cause a paper jam. For this reason, each paper transport member is stopped so that each of the recording sheets within the transport path of the laser beam printer system stop.

When the number cf recording sheets existing within the laser beam printer system is No (the interleave number), the recording sheets are stopped at No locations within the laser beam printer system. However, the recording sheet is not stopped at the printing and fixing part. The delay of the image data can easily be absorbed by stopping the recording sheets at the No locations within the laser beam printer system.

As a modification, it is of course possible to stop the recording sheets at No-1 locations within the laser beam printer system.

In the case where the recording sheets are stopped at No locations within the laser beam printer system, a sensor for detecting the recording sheet must be provided at each of No locations. As a result, the mechanisms and control operations become complex and increases the cost of the laser beam printer system.

But when the recording sheets are stopped at No-1 locations, the total number of sensors which need to be provided is No-1. For this reason, the mechanisms and control operations become simple compared to the case where No sensors must be provided.

In the interleave mode shown in FIG. 6, the stopping position c, d and e exclude the printing part b. The timing with which the recording sheet is stopped at one of the stopping positions c, d and e is set after the recording sheet passes the printing part b and before another recording sheet reaches the printing part b. The delay in the image data described above does not take into account a delay which is introduced during the printing in the printing part b, but takes into account the delay in the image data which often occurs in units of pages due to the waiting of printing job. Hence, it is possible to sufficiently cope with the delay in the image data by stopping the recording sheets at the stopping positions c, d and e.

As another measure against the delay in the image data, it is possible to provide means for stopping at least one of the paper transport members. In this case, the one paper transport member is stopped when the delay is introduced in the image data, and in addition, the recording sheets which follow the recording sheet which is stopped at the one paper transport member are ejected outside the transport path. Then, the one paper transport member is enabled after the delay in the image data is absorbed.

The present invention is not limited to the aforementioned embodiments, and variations and modifications may be made without departing from the scope of the claimed invention.

What is claimed is:

1. A method for forming a duplex print, in which a recording sheet has images formed on both sides thereof, in an image forming apparatus which includes paper supplying means for supplying the recording sheet to a transport path within said image forming apparatus, said paper supplying means capable of supplying different sized recording sheets, transport means for transporting the recording sheet in said transport path, image forming means for forming an image on one side of the recording sheet based on input image data, reversing means for reversing the recording sheet which has the image formed on the one side thereof and refeeding means for refeeding the reversed recording sheet to said image forming means, said method comprising the following steps (a) through (f):

(a) setting an interleave number depending on the size of the recording sheet supplied from said paper supplying means, said interleave number being a maximum number of recording sheets which can be located within the transport path with a non-stacked arrangement;

(b) controlling said paper supplying means, said image forming means, said transport means, said reversing means and said refeeding means so that recording sheets have images formed on first sides thereof are located in the transport path with the non-stacked arrangement, the number of recording sheets located within the transport path being equal to the interleave number set by said step (a);

(c) forming an image on the first side of the recording sheet supplied from the paper supplying means and forming an image on a second side of a recording sheet refed from said refeeding means by said image forming means in a predetermined sequence so that the number of recording sheets located in the transport path is kept equal to or less than the interleave number;

(d) determining whether or not a the size of the recording sheet is supplied from said paper supplying means changes;

(e) changing the interleave number set by said step (a) to a minimum interleave number when said step (d) determines that the size of the recording sheet has changed, said minimum interleave number being an interleave number dependent on the largest recording sheet of recording sheets which can be supplied to said image forming apparatus; and (f) controlling said paper supplying means, said image forming means, said transport means, said reversing means and said refeeding means so that new sized recording sheets have images formed on first sides thereof are located in the transport path with the non-stacked arrangement, the number of new sized recording sheets located within the transport path being equal to or less than the minimum interleave number.

2. A method as claimed in claim 1, wherein said step (c) includes a first step of forming an image on the first side of the recording sheet supplied from said paper supplying means by said image forming means and a second step of determining whether or not the number of recording sheets located within the transport path becomes equal to the interleave number set by said step (a), and wherein said first step is repeatedly carried out until the number of recording sheets located within the transport path becomes equal to the interleave number.

3. A method as claimed in claim 1, wherein said step (d) includes a step of determining whether or not an interleave number which is set by step (a) with respect to the recording sheet supplied from said paper supplying means is equal to an interleave number which was set by step (a) with respect to a previous recording sheet located in the transport path, and wherein said step (d) determines that the size of the recording sheet changes when the interleave number which is set by said step (a) with respect to the recording sheet supplied from said paper supplying means is not equal to the interleave number which was set by said step (a) with respect to the previous recording sheet located in the transport path.

4. A method as claimed in claim 1, wherein said step (f) includes a first step of determining whether or not the number of new sized recording sheets located within the transport path is less than the minimum interleave number, and a second step of successively forming images on the second sides of the new sized recording sheets refed to said image forming means by said refeeding means until said first step determines that the number of new sized recording sheets located in the transport path is less than the minimum interleave number.

5. A method as claimed in claim 1 further comprising a step (g) of:

(g) setting an interleave number depending on the new sized recording sheets after the number of the new sized recording sheets located in the transport path becomes equal to the minimum interleave number, wherein, after said step (g), said steps (b) and (c), with respect to the new sized recording sheets are sequentially carried out again.

6. A method for forming a duplex print, in which a recording sheet has images formed on both sides thereof, in an image forming apparatus which includes paper supplying means for supplying the recording sheet to a transport path within said image forming apparatus, said paper supplying means having a plurality of supplying units housing recording sheets, the size of the recording sheet housed by at least one of the supplying units differing from the sizes of the recording sheets housed by the other supplying units, transport means for transporting the recording sheet in said transport path, image forming means for forming an image on one side of the recording sheet based on input image data, reversing means for reversing the recording sheet which has the image formed on the one side thereof and refeeding means for refeeding the reversed recording sheet to said image forming means, said method comprising the following steps (a) through (f) of:

(a) setting an interleave number depending on the size of the recording sheet supplied from said paper supplying means, said interleave number being a maximum number of recording sheets which can be located within the transport path with a non-stacked arrangement;

(b) controlling said paper supplying means, said image forming means, said transport means, said reversing means and said refeeding means so that recording sheets have images formed on first sides thereof are located in the transport path with the non-stacked arrangement, the number of recording sheets located within the transport path being equal to the interleave number set by said step (a);

(c) forming an image on the first side of the recording sheet supplied from the paper supplying means and forming an image on a second side of a recording sheet refed from the refeeding means by said image forming means in a predetermined sequence so that the number of recording sheets located in the transport path is kept equal to or less than the interleave number;

(d) determining whether or not the size of the recording sheet supplied from said paper supplying means changes;

(e) changing the interleave number set by said step (a) to a minimum interleave number when said step (d) determines that the size of the recording sheet has, said minimum interleave number being an interleave number dependent on the largest recording sheets which is actually housed by said supplying units; and (f) controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

7. A method as claimed in claim 6, wherein said step (c) includes a first step of forming an image on the first side of the recording sheet supplied from said paper supplying means by said image forming means and a second step of determining whether or not the number of recording sheets located within the transport path becomes equal to the interleave number set by said step (a), and wherein said first step is repeatedly carried out until the number of recording sheets located within the transport path becomes equal to the interleave number.

8. A method as claimed in claim 6, wherein said step (d) includes a step of determining whether or not an interleave number which is set by step (a) with respect to the recording sheet supplied from said paper supplying means is equal to an interleave number which was set by step (a) with respect to a previous recording sheet located in the transport path, and wherein said step (d), determines that the size of the recording sheet changes when the interleave number which is set by said step (a) with respect to the recording sheet supplied from said paper supplying means is not equal to the interleave number which was set by said step (a) with respect to the previous recording sheet located in the transport path.

9. A method as claimed in claim 6, wherein said step (f) includes a first step of determining whether or not the number of new sized recording sheets located within the transport path is less than the minimum interleave number, and a fourth step of successively forming images on the second sides of the new sized recording sheets refed to said image forming means by said refeeding means until said first step determines that the number of new sized recording sheets located in the transport path is less than the minimum interleave number.

10. A method as claimed in claim 6, wherein the minimum interleave number is determining by the following steps of:

detecting the largest recording sheet of the recording sheets which are actually housed by said supplying units; and determining an interleave number depending on the largest recording sheet detected by said step of detecting the largest recording sheet.

11. A method as claimed in claim 6 further comprising a step (g) of:

(g) setting an interleave number depending on the new sized recording sheets after the number of the new sized recording sheets located in the transport path becomes equal to the minimum interleave number, wherein, after said step (g), said steps (b) and (c), with respect to the new sized recording sheets, are sequentially carried out again.

12. A method for forming a duplex print, in which a recording sheet has images formed on both sides thereof, in an image forming apparatus which includes paper supplying means for supplying the recording sheet to a transport path within said image forming apparatus, said paper supplying means capable of supplying different sized recording sheets, transport means for transporting the recording sheet in said transport path, image forming means for forming an image on one side of the recording sheet based on input image data, reversing means for reversing the recording sheet which has the image formed on the one side thereof and refeeding means for refeeding the reversed recording sheet to said image forming means, said method comprising the following steps (a) through (f):

(a) setting an interleave number depending on the size of the recording sheet supplied from said paper supplying means, said interleave number being a maximum number of recording sheets which can be located within the transport path with a non-stacked arrangement;

(b) controlling said paper supplying means, said image forming means, said transport means, said reversing means and said refeeding means so that recording sheets have images formed on first sides thereof are located in the transport path with the non-stacked arrangement, the number of recording sheets located within the transport path being equal to the interleave number set by said step (a);

(c) forming an image on the first side of the recording sheet supplied from the paper supplying means and forming an image on a second side of a recording sheet refed from said refeeding means by said image forming means in a predetermined sequence so that the number of recording sheets located in the transport path is kept equal to or less than the interleave number;

(d) determining whether or not a the size of the recording sheet supplied from said paper supplying means changes;

(e) changing the interleave number set by said step (a) to a minimum interleave number when said step (d) determines that the size of the recording sheet has changed, said minimum interleave number being an interleave number dependent on the largest recording sheet of the new sized recording sheet and the recording sheets supplied to the transport path; and (f) controlling said paper supplying means, said image forming means, said transport means, said reversing means and said refeeding means so that new sized recording sheets have images formed on first sides thereof are located in the transport path with the non-stacked arrangement, the number of new sized recording sheets located within the transport path being equal to or less than the minimum interleave number.

13. A method as claimed in claim 12, wherein said step (c) includes a first step of forming an image on the first side of the recording sheet supplied from said paper supplying means by said image forming means and a second step of determining whether or not the number of recording sheets located within the transport path becomes equal to the interleave number set by said step (a), and wherein said first step is repeatedly carried out until the number of recording sheets located within the transport path becomes equal to the interleave number.

14. A method as claimed in claim 12, wherein said step (d) includes a step of determining whether or not an interleave number which is set by step (a) with respect to the recording sheet supplied from said paper supplying means is equal to an interleave number which was set by step (a) with respect to a previous recording sheet located in the transport path, and wherein said step (d) determines that the size of the recording sheet changes when the interleave number which is set by said step (a) with respect to the recording sheet supplied from said paper supplying means is not equal to the interleave number which was set by said step (a) with respect to the previous recording sheet located in the transport path.

15. A method as claimed in claim 12, wherein said step (f) includes a first step of determining whether or not the number of new sized recording sheets located within the transport path is less than the minimum interleave number, and a fourth step of successively forming images on the second sides of the new sized recording sheets refed to said image forming means by said refeeding means until said first step determines that the number of new sized recording sheets located in the transport path is less than the minimum interleave number.

16. A method as claimed in claim 12, wherein the minimum interleave number is determining by the following steps of:

storing interleave numbers corresponding to the recording sheets located within the transport path; and selecting the smallest interleave number of the interleave numbers depended on the new sized recording sheet and the interleave numbers stored by said step of storing interleave numbers, wherein the selected smallest interleave number is the minimum interleave number.

17. A method as claimed in claim 12 further comprising a step (g) of:

(g) setting an interleave number depending on the new sized recording sheets after the number of the new sized recording sheets located in the transport path becomes equal to the minimum interleave number, wherein, after said step (g), said steps (b) and (c) with respect to the new sized recording sheets are sequentially carried out again.

18. An apparatus for forming a duplex print, in which a recording sheet has images formed on both sides thereof, comprising:

paper supplying means for supplying the recording sheet to a transport path within said image forming apparatus, said paper supplying means capable of supplying different sized recording sheets, transport means for transporting the recording sheet in said transport path;

image forming means for forming an image on one side of the recording sheet based on input image data;

reversing means for reversing the recording sheet which has the image formed on the one side thereof;

refeeding means for refeeding the reversed recording sheet to said image forming means;

first setting means for setting an interleave number depending on the size of the recording sheet supplied from said paper supplying means, said interleave number being a maximum number of recording sheets which, can be located within the transport path with the non-stacked arrangement;

first control means for controlling said paper supplying means, said image forming means, said transport means, said reversing means and said refeeding means so that recording sheets having images formed on first sides thereof are located in the transport path with the non-stacked arrangement, the number of recording sheets located within the transport path being equal to the interleave number set by said first setting means;

duplex printing means for forming an image on a second side of a recording sheet refed from said refeeding means in a predetermined sequence so the number of recording sheets located in the transport path is kept equal to or less than the interleave number;

determining means for determining whether or not the size of a recording sheet supplied from said paper supplying means changes;

changing means for changing the interleave number set by said first setting means to a minimum interleave number when said determining means determines that the size of the recording sheet is changes, said minimum interleave number being an interleave number dependent on the largest recording sheet which can be supplied to said image forming apparatus; and second control means for controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

19. An apparatus as claimed in claim 18 further comprising:

second setting means for setting an interleave number depending on the new sized recording sheet after the number of new sized recording sheet located in the transport path becomes equal to the minimum interleave number, wherein, after said second setting means sets the interleave number depending on the new sized recording sheet, said first control means and said duplex printing means operate based on the interleave number set by said second setting means.

20. An apparatus for forming a duplex print, in which a recording sheet has images formed on both sides thereof, comprising:

paper supplying means for supplying the recording sheet to a transport path within said image forming apparatus, said paper supplying means having a plurality of supplying units housing recording sheets, the size of the recording sheet housed by at least one of the supplying units differing from the sizes of the recording sheets housed by the other supplying units;

transport means for transporting the recording sheet in said transport path;

image forming means for forming an image on one side of the recording sheet based on input image data;

reversing means for reversing the recording sheet which has the image formed on the one side thereof;

refeeding means for refeeding the reversed recording sheet to said image forming means, first setting means for setting an interleave number depending on the size of the recording sheet supplied from said paper supplying means, said interleave number being a maximum number of recording sheets which can be located within the transport path with a non-stacked arrangement;

first control means for controlling said paper supplying menas, said image forming means, said transport means, said reversing means and said refeeding means so that recording sheets having images formed on first sides thereof are located in the transport path with the non-stacked arrangement, the number of recording sheets located within the transport path being equal to the interleave number set by said first setting means;

duplex printing means for forming an image on a second side of a recording sheet refed from said refeeding means in a predetermined sequence so the number of recording sheets located in the transport path is kept equal to or less than the interleave number;

determining means for determining whether or not the size of recording sheet supplied from said paper supplying means changes;

changing means for changing the interleave number set by said first setting means to the minimum interleave number when said determining means determines that the size changes, said minimum interleave number dependent on the largest recording sheet which is actually housed by said supplying units; and second control means for controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

21. An apparatus as claimed in claim 20, wherein said changing means includes:

detecting means for detecting the largest recording sheet of the recording sheets which are actually housed by said supplying units; and means for determining an interleave number depending on the largest recording sheet detected by said detecting means, and wherein the interleave, number determined by said interleave number determining means is used as the minimum interleave number.

22. An apparatus as claimed in claim 20 further comprising:

second setting means for setting an interleave number depending on the new sized recording sheet after the number of new sized recording sheet located in the transport path becomes equal to the minimum interleave number, wherein, after said second setting means sets the interleave number depending on the new sized recording sheet, said first control means and said duplex printing means operate based on the interleave number set by said second setting means.

23. An apparatus for forming a duplex print, in which a recording sheet has images formed on both sides thereof, comprising:

supplying means for supplying the recording sheet to a transport path within said image forming apparatus, said paper supplying means capable of supplying different sized recording sheets;

transport means for transporting the recording sheet in said transport path;

image forming means for forming an image on one side of the recording sheet based on input image data;

reversing means for reversing the recording sheet which has the image formed on the one side thereof;

refeeding means for refeeding the reversed recording sheet to said image forming means, first setting means for setting an interleave number depending on a size of the recording sheet supplied from said paper supplying means, said interleave number being a number of recording sheets which can be located within the transport path with a non-stacked arrangement;

first control means for controlling said paper supplying means, said image forming means, said transport means, said reversing means and said refeeding means so that recording sheets having images formed on first sides thereof are located in the transport path with the non-stacked arrangement, the number of recording sheets located within the transport path being equal to the interleave number set by said first setting means;

duplex printing means for forming an image on the first side of the recording sheet supplied from the paper supplying means and forming an image on a second side of a recording sheet refed from said refeeding means by said image forming means in a predetermined sequence so that a condition where the number of recording sheets located in the transport path is equal to or less than the interleave number is maintained;

determining means for determining whether or not a size of a recording sheet supplied from said paper supplying means is changed;

changing means for changing the interleave number set by said first setting means to a minimum interleave number when said determining means determines that the size of the recording sheet is changed, said minimum interleave number being an interleave number depending on the largest recording sheet of the new sized recording sheet and the recording sheets supplied to the transport path; and second control means for controlling said paper supplying means, said image forming means, said transport means, said reversing means and said refeeding means so that new sized recording sheets having images formed on first sides thereof are located in the transport path with the non-stacked arrangement, the number of new sized recording sheets located within the transport path being equal to or less than the minimum interleave number.

24. An apparatus as claimed in claim 23, wherein said changing means includes:

storing means for storing interleave numbers corresponding to the recording sheets located within the transport path; and selecting means for selecting a smallest interleave number of the interleave number depending on the new sized recording sheet and the interleave numbers stored by said step of storing interleave numbers, and wherein the selected smallest interleave number is used as the minimum interleave number.

25. An apparatus as claimed in claim 23 further comprising:

second setting means for setting an interleave number depending on the new sized recording sheet after the number of the new sized recording sheet located in the transport path becomes equal to the minimum interleave number, wherein, after said second setting means sets the interleave number depending on the new sized recording sheet, said first control means and said duplex printing means operate based on the interleave number set by said second setting means.

* * * * *